US007363187B2

(12) United States Patent
Winkler et al.

(10) Patent No.: US 7,363,187 B2
(45) Date of Patent: Apr. 22, 2008

(54) METHOD AND APPARATUS FOR AUTOMATICALLY TESTING A RAILROAD INTERLOCKING

(75) Inventors: Joseph C. Winkler, Punta Gorda, FL (US); Paul J. Galburt, Punta Gorda, FL (US); Donald P. Crosby, Lady Lake, FL (US); David K. Rayna, Malverne, NY (US); Christopher V. Traynor, Sarasota, FL (US); George T. Briechle, Punta Gorda, FL (US)

(73) Assignee: Ultra-Tech Enterprises, Inc., Punta Gorda, FL (US)

( * ) Notice: Subject to any disclaimer, the term of this patent is extended or adjusted under 35 U.S.C. 154(b) by 57 days.

(21) Appl. No.: 11/172,461

(22) Filed: Jun. 30, 2005

(65) Prior Publication Data

US 2006/0009940 A1 Jan. 12, 2006

Related U.S. Application Data

(60) Provisional application No. 60/586,474, filed on Jul. 8, 2004.

(51) Int. Cl.
*G06F 19/00* (2006.01)

(52) U.S. Cl. ..... 702/115; 246/146

(58) Field of Classification Search ..... 702/115, 702/182, 185, 120–121; 246/436, 131, 146
See application file for complete search history.

(56) References Cited

U.S. PATENT DOCUMENTS 5,463,552 A * 10/1995 Wilson et al. ..... 701/117

* cited by examiner

*Primary Examiner*—Edward Raymond
(74) *Attorney, Agent, or Firm*—Chase Law Firm, P.C.

(57) ABSTRACT

A railroad signal system interlocking is automatically tested. A control point interface corresponding to a predetermined function of the interlocking has an isolated section and a control section. The isolated section is connected with the interlocking and has a normal, inactivated state during operation of the interlocking, and an activated state for testing the interlocking by detecting an electrical characteristic representing the status of the predetermined function executed by the interlocking. The control section drives the isolated section to its activated state and receiving an output from the isolated section in response to the detected electrical characteristic, and delivers a status report.

16 Claims, 24 Drawing Sheets

PDA
38
2.4GHz LAN
36
ETHERNET
34
20
SERVER
24
VHF WAN
42
RS232
40
44
RS232
26
CODE EMULATOR
28
MODEM
30
LOGIC CONTROLLER
32
22

REMOTE INTERLOCKING SITES
46
CONCENTRATOR
56
RS232
MicroLAN RS422
50
HUB
MicroLAN RS232
48
CPI
54
MicroLAN RS422
50
HUB
52
MicroLAN RS232
CPI
CORRES-PONDENCE RELAY
80
APPROACH STICK/ RESET TIMER
78
LAMP CURRENT
72
TRACK SHUNT
74
SWITCH MOTOR
76

272

332

METHOD AND APPARATUS FOR AUTOMATICALLY TESTING A RAILROAD INTERLOCKING

CROSS REFERENCE TO RELATED APPLICATIONS

This application claims the benefit of prior filed, co-pending Ser. No. 60/586,474, filed Jul. 8, 2004, entitled METHOD AND APPARATUS FOR AUTOMATICALLY TESTING A RAILROAD INTERLOCKING.

FIELD OF THE INVENTION

The present invention relates to railroad signal systems, and more particularly, to a method and system for automatically testing a railroad signal system interlocking or control point.

BACKGROUND OF THE INVENTION

Railroad signal system interlockings or control points are periodically tested to ensure that they are fully functional. An interlocking is a collection of electrical and electronic assemblies including but not limited to relays, logic controllers, signal lamps, switch motors, timers, coding and decoding units, modems, and other miscellaneous components and connections. The purpose of the interlocking is to control and monitor a railroad control point such as an end or siding, crossover, or double crossover.

An end of siding is a single switch that branches a single track into two tracks. A crossover is a pair of switches that allows a train operating on a first track to cross to a second parallel track, but only when the train is operating in a specific direction. A train operating in the opposite direction on the second track may similarly cross to the first track when the switches are properly aligned. A double crossover consists of two single crossovers in sequence or, where space does not permit, overlapping one another. The double crossover allows trains operating in either direction on either track to cross to the other parallel track.

Many of the interlockings in the United States consist of one of these three types. However, in areas where additional tracks are involved or multiple routes intersect, more complex interlockings are implemented as required by the track configurations and the routing requirements.

An interlocking is controlled by a dispatcher and by the signaling equipment installed in bungalows or field cases alongside the tracks near the site. Monitoring signals sent to the dispatcher indicate any tracks occupied by trains, any signals cleared to a permissive state, and switch positions. The dispatcher can issue commands to clear a signal (enable or allow a permissive state to be displayed), restore a signal (disable or force a restrictive state to be displayed), or move a switch. However, the interlocking will respond to the command only if the conditions that exist at the interlocking are safe and thus allow the command to be safely implemented.

A significant purpose for the interlocking plant is safety. Some unsafe conditions that are prevented by the design and implementation of the interlocking plant are throwing a switch while a train is passing over the switch (causes a derailment), switching a train onto another track occupied by another train (causes a head on or rear end collision), or throwing a switch in front of a moving train that had previously been cleared to proceed and is now unable to stop in time when the signal or switch position becomes visible to the engineer. In addition, other unsafe conditions are monitored and can cause signal aspects to change to less permissive or even restrictive indications when they are detected. Examples of these are hand switch positions for sidings and slide fences. A hand switch that is manually thrown, usually to permit a switching engine to operate on the track, presents an obstruction or derailment possibility, and changes any approach signal to a restrictive state. Similarly, a slide fence detects possible track obstructions such as falling rock or landslides when the slide fence is breached, and changes the approach signals to a restrictive state.

An interlocking is protected by signals at the entry points. These signals are called home signals. In addition to preventing unsafe commands by the dispatcher, the interlocking also controls the home signal aspects displayed on the signals. The aspects displayed represent rules for proceeding that are well known and understood by the engineer operating the train. The types of information conveyed by these rules include allowable speed, position of the switch being approached, expected condition of the following signal, expectation of trains ahead on the same track either stopped or proceeding in the same direction, or expectation of other possible track obstructions. In these latter two conditions, the train may be allowed to proceed but is restricted to a speed that permits the engineer to stop within his visibility distance ahead on the track.

Signals may also display aspects that indicate the condition of the next signal down the track. Communications are sent between interlockings on pole lines or via coded signals transmitted in the rails. This allows one interlocking to communicate its state to adjacent interlockings and permits higher speed operation through several interlockings in sequence when the track has been cleared and the route safely lined through each interlocking. Signals at a given interlocking thus display aspects that may depend upon dispatcher commands received, conditions within the interlocking, and conditions at a following interlocking.

The interlocking is important to the basic safety of the railroad signaling system. Interlockings employ vital circuits designed and implemented to provide failsafe operation in a highly reliable manner. The circuitry typically uses gravity relays in vital circuits and is connected with heavy gauge wire protected by high quality, low leakage insulation. Lightning arrestors, crimped ring terminals, and stud-mounted connections are all employed to ensure high reliability. However, to ensure that the system is fully functional, periodic testing is mandated by the Federal Railway Administration (FRA) to ensure that the safety features remain effective. An operational test is performed every four years on every interlocking. Since there are many thousands of these interlocking plants situated along the railroads, considerable time, labor, and cost are dedicated to meeting these testing requirements.

Currently, testing is performed by a maintenance crew. In order to test an interlocking, the crew obtains track time from the dispatcher. This means that the dispatcher has given up control of the interlocking for the duration of the tests. Typically, the dispatcher gives up control of the interlocking under test as well as the adjacent interlockings, since control signals are generated by the adjacent interlockings to completely test the operation of the interlocking under test. Thus, train operation is suspended in this area for the duration of the tests. The consequence of this interruption in service is unwanted train delays and possible loss of revenue.

In order to test an interlocking, the maintenance crew operates the interlocking in all combinations and attempts to override the safety mechanisms by locally commanding unsafe conditions. These tests are broken down into a series of tests called Route Locking, Time Locking, and Switch and Signal Indication.

Briefly, Route Locking tests to ensure that a switch cannot be moved or an opposing route lined (enabled) once a home signal has been cleared to allow a train to pass. Restoring the home signal to STOP starts a timer that locks the interlocking and prevents any routes through the interlocking from being cleared until time has expired.

Time Locking tests to ensure that a switch cannot be moved or an opposing route lined (enabled) once a home signal has been cleared to allow a train to pass and a train has entered the interlocking. Detection of a train passing through the interlocking by successively shunting the interlocking track circuit and the following track circuit prevents the timer from starting. However, continued presence of the (long) train in the interlocking prevents the signals from being cleared or the switch from being moved until the train has passed completely through the interlocking. The signal may then be cleared again for a following train. The permissive aspect displayed, however, will be a function of the communication signals arriving from the following interlocking. If the train still occupies the block(s) between the interlockings, then the signal may be restrictive.

Finally, Switch and Signal Indication tests that all the indications reported to the dispatcher and the interlocking plant from the switch position monitors are operating properly, and that the signals display the correct aspect indications for all operating and communication input conditions.

These tests are complex and exhaustive. A number of maintenance workers are required. The realities of railroad operation may not allow sufficiently long blocks of track time to fully test an interlocking without releasing track time and allowing a train to pass through an operational interlocking. Communication among the maintenance workers on the test team is via telephone, portable radios, and shouting as required. This presents an opportunity for misunderstood commands and requests, erroneous reporting of results, and the need to repeat commands and steps until the test has been correctly performed.

SUMMARY OF THE INVENTION

In one aspect of the present invention the aforementioned problems and complications are addressed by automatically testing a railroad signal system interlocking. A plurality of control point interfaces are provided, each corresponding to a predetermined function of an interlocking and having an isolated section and a control section. The isolated section of each interface is connected to a current source in the interlocking having an electrical characteristic representing the status of a predetermined function executed by the interlocking, and the control section is coupled to the isolated section of the interface to detect the status of the corresponding function. The status of each of the functions is reported to a central server, and a report of the status of the interlocking is provided. Other aspects include providing a method and a system to capture the interlocking design information, generate a design definition, generate test scripts, execute the test scripts under control of the operator, display test progress, and generate test reports.

DETAILED DESCRIPTION

Figure 1:
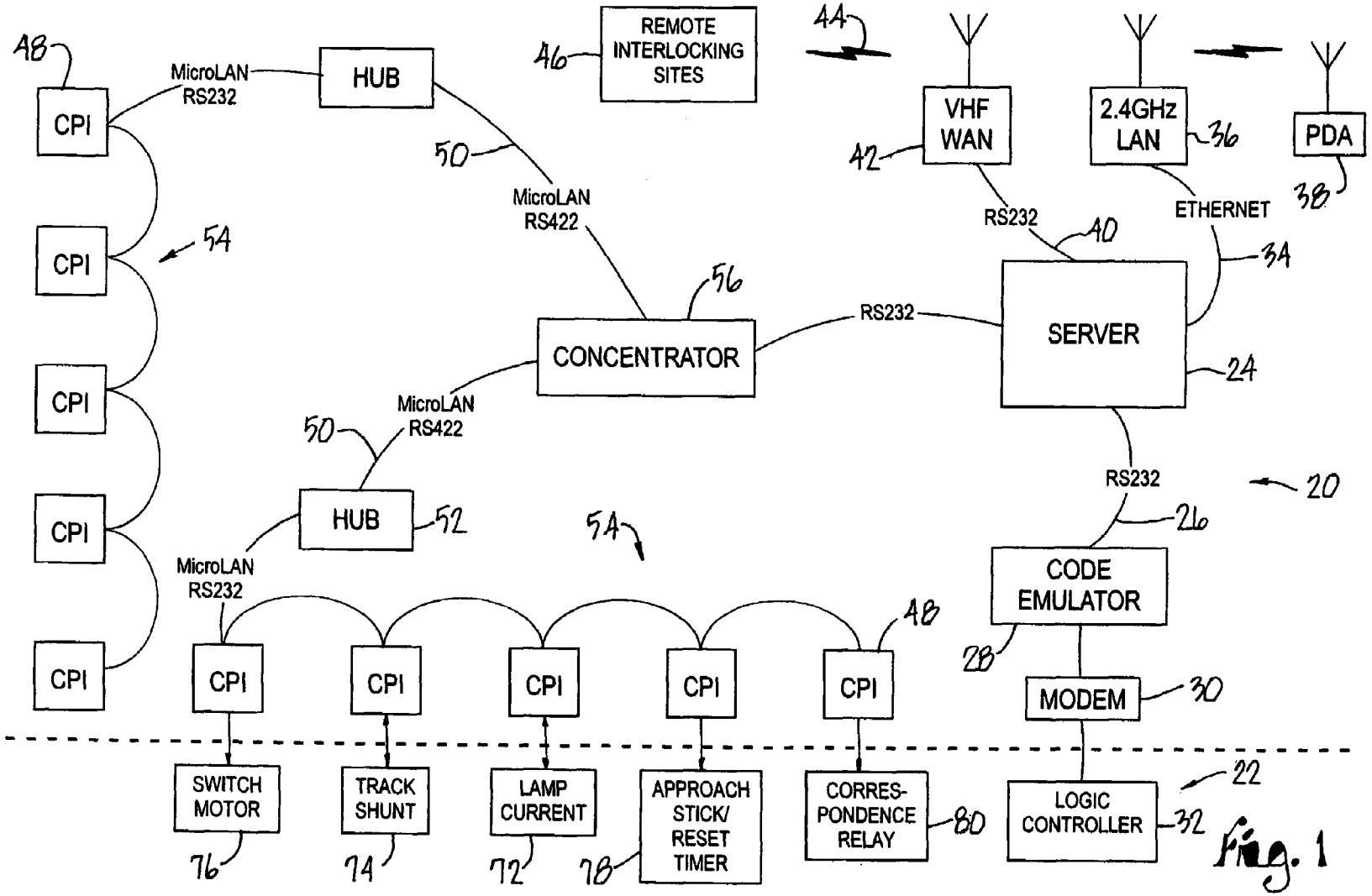
FIG. 1 is a block diagram illustrating the system for testing a railroad interlocking.

The system hardware configuration is set forth below followed by the methodology used to capture the design and execute the testing. FIG. 1 illustrates the system equipment 20 deployed at an interlocking under test 22. A server 24, which may be a laptop computer equipped with the necessary interfaces, hosts the software and controls the execution of the test. Commands to the interlocking under test 22 are sent via an RS-252 serial port 26. A code emulator interface unit 28 converts this information to the format required by the specific equipment in the interlocking under test 22. Several different code emulators may be employed to interface with legacy equipment. Alternatively, multiple interfaces may be implemented in a single code emulator 28. The output interface of the code emulator is a modem 30 connected to a logic controller 32 that is part of the interlocking plant. Indications from the logic controller 32 are also read back by the server 24. This interface replaces the dispatcher interface that normally controls the interlocking.

An Ethernet connection 34 to a 2.4 GHz Local Area Network (LAN) 36 supports a remote device for some interactive operations such as a wireless personal digital assistant (PDA) 38. The PDA 38 is programmed with commercially available web browser software. Communication to and from the PDA 38 is via html pages served by the server 24. A serial port 40 using RS-232 protocol interfaces with a very high frequency (VHF) digital radio 42. This radio provides a wide area network (WAN) link 44 to the adjacent interlockings 46 or control points, which operate as clients and may include the components shown in FIG. 1.

Physical control and monitoring of the interlocking plant during test is performed by electronic units called Control Point Interfaces (CPIs) 48. These CPIs 48 are connected on a MicroLAN bus 50 that uses RS-422 protocol and delivers DC power to the CPIs 48. Each hub 52 can support eight CPIs 48 connected in a daisy chain 54 or star configuration. Two hubs 52 each supporting five CPIs are illustrated. A concentrator 56 supports up to eight hubs 52, for a total 64 CPIs. Although a daisy chain connection is illustrated in FIG. 1 for clarity, other configurations, such as a star configuration, may be implemented for example.

Figure 2:
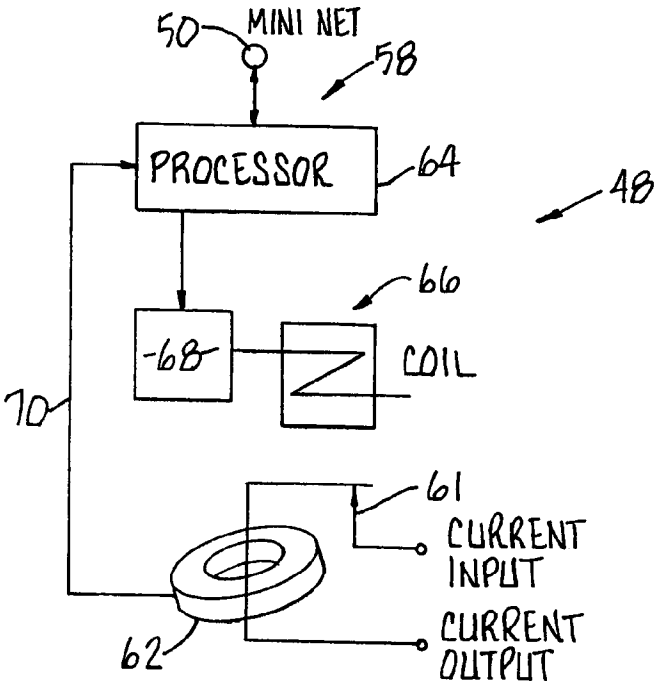
FIG. 2 is a control point interface block diagram.

A block diagram of the CPI is illustrated in FIG. 2. Each CPI 48 contains an interface and control section 58 that is electrically connected to the system, and a separate interface section 60 that is electrically isolated from the system. Maintaining electrical isolation prevents leakage currents from interfering with the operation of the vital circuits of the interlocking. The isolated interface section 60 contains connections to the Form C contacts 61 of a relay 66 such that a normally open pair or a normally closed pair of contacts 61 is available for connection to the interlocking. Using the normally open pair of connections allows a jumper connection to be connected when the relay is actuated. Using a normally closed pair of connections as shown permits insertion of the CPI 48 into an interlocking circuit. When the relay is actuated, the circuit is opened. In either case, the isolated connection 60 through the CPI 48 also passes through a magnetic core equipped with a Hall effect sensor 62 to measure current flow and polarity. This sensing mechanism preserves the electrical isolation required for a normally closed connection to be permanently inserted in a vital circuit. Once the MicroLAN connection 50 is removed from the CPI 48, all power and communication is removed and the relay remains in the normally closed state and may not be activated.

CPIs 48 may also be implemented with all three Form C connections (not shown). In this case, the connection to the common lead would be routed through the magnetic core for current sensing. This configuration CPI may then sense current when the relay is open as well as when it is closed. This configuration is particularly useful for applications that require dropping approach stick relays and resetting timers as will be described later.

The interface and control section 58 of the CPI 48 connected to the system interfaces with the MicroLAN RS-422 protocol and the DC power feed. A microcontroller 64 with internal flash memory controls the CPI 48 by communicating with the server 24, operating the relay 66 through the relay driver 68 connected to the relay coil, and measuring the current flow on line 70 from the Hall effect sensor 62. The Hall effect sensor output is amplified, buffered, filtered, and converted to a digital signal by the microcontroller 64. The digitized signal is compared to a downloaded threshold and the results are reported back to the system server 24 when polled. CPI measurement algorithms detect current levels for both AC and DC current. Timing algorithms debounce the sensor output on line 70 and detect flashing rates as required. Flashing rate detection is required for flashing lamps in signals and for coded track circuits. Each CPI 48 contains a unique serial number programmed into the microcontroller internal flash memory during factory programming to identify the CPI 48 on a network.

CPIs 48 are connected to the interlocking 22 in order to automatically monitor the states of various circuits that control the operating components of the interlocking as illustrated, for example, at 72, 74, 76, 78 and 80 in FIG. 1. Signal lamp circuits 72 are routed through the contacts of a normally closed CPI 48. The CPI 48 continuously monitors the current flow and can therefore detect when the lamp is turned on, when it is flashing (typically at a rate between 20 and 40 pulses per minute), and when it is turned off. The relay 66 can be commanded to open, causing the lamp to go out. This tests the Light Out function of the interlocking 22, which changes some signal indications when a critical lamp is burned out. Opening the relay 66 simulates a burned out lamp.

Track circuits 74 are shunted by the normally open connections of CPIs 48. Tracks are shunted during testing by activating the CPI relay 66 to simulate the presence of a train in the track circuit block. Switch power 76 is wired through the normally closed contacts of a pair of CPIs 48. Opening these relays removes power from the switch motors as required during some tests.

Timer relays are reset by momentarily applying 28 volts to the 3E post of the appropriate Approach Stick (AS) relay 78. In other tests, the AS relay 78 is disconnected from its circuit (dropped). CPIs may be used to implement these functions in two ways. If only the timer reset function is required, a normally open CPI is connected to the 3E post of the AS relay 78 and the other lead is connected to 28 volts. When the relay is activated, the 28 volts is applied to the AS relay 3E post and the timer is reset. If the AS relay 78 must also be dropped, a normally closed CPI is inserted in the circuit between the AS relay 3E post and the rest of the circuit with the relay common lead connected to the 3E post. The AS relay is dropped when the relay is activated (opened). The normally open lead of the AS is connected to one lead of a second, normally open CPI. The other lead of this second CPI is connected to 28 volts. When both relays are activated, 28 volts is applied to the AS relay 3E post and the timer is reset. Switch correspondence relays are also dropped for some test steps.

Normally closed CPIs are wired into the correspondence relay coil circuit 80 to accomplish this action when the relay is activated. In all these applications, the CPIs 48 may be permanently wired into these vital circuits. The design inherently provides electrical isolation, and disconnecting the CPIs 48 from the MicroLAN 50 (and power) when not testing prevents any activation of the CPI relay 66.

CPIs 48 may be permanently connected to the interlocking 22 to provide test stimuli during the automatic test procedures. When it is time to perform an interlocking test, the CPIs 48 are wired to the hub 52 and the remainder of the equipment is connected as illustrated in FIG. 1. The system is stimulated through the CPIs and code emulator commands. System performance is measured through CPI sensors and code emulator indications.

Figure 3:
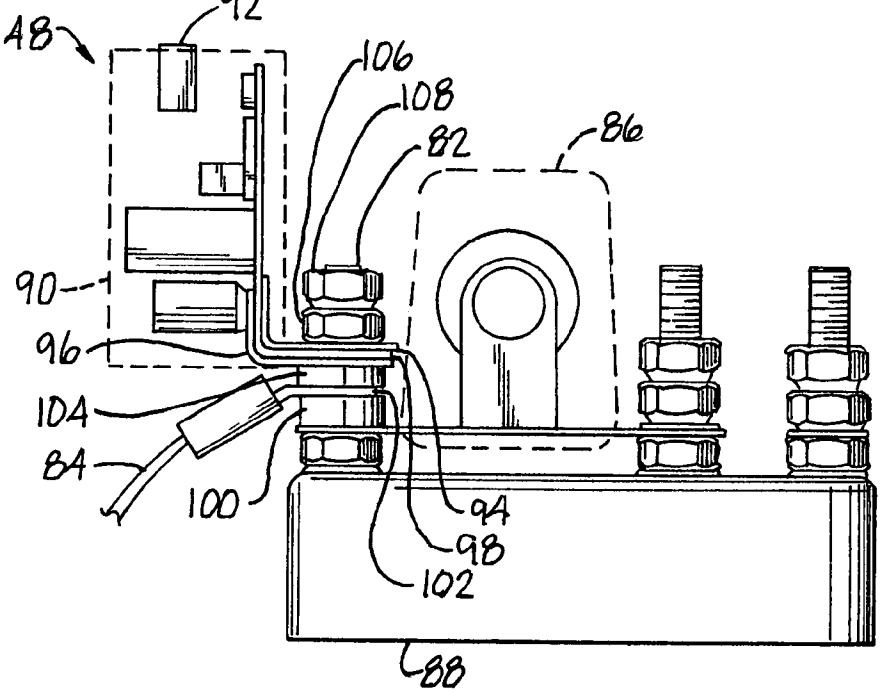
FIG. 3 is an illustration of a control point interface installation.

Referring to FIG. 3, CPIs 48 are designed to be easily installed in a bungalow (not shown). Most CPIs 48 may be connected directly to a stud 82 at the point where the field wiring 84 enters the bungalow or field case. These entry points are protected by lightning arrestors 86 that are mounted on an insulated base 88. The CPI design obviates additional wires for the CPI connections by using this mounting location. The CPI mounting and connection may be made to either side of the lightning arrestor 86. FIG. 3 illustrates the CPI design and installation connection to the field side of the lightning arrestor 86. The preferred connection is to the bungalow side of the lightning arrestor 86.

The CPI 48 measures currents in selected circuits and acts as an actuator to simulate certain operational conditions. In order to minimize test setup costs and time, it is desirable that CPIs 48 be left installed in each interlocking plant. The CPI 48 is small, inexpensive, and easily installed in the interlocking 22. In addition, CPIs 48 should not interfere with the operation of the interlocking 22. Specifically, they are electrically isolated, completely deactivated, and should not degrade the safety, reliability, or operation of the vital circuits. Isolation and deactivation are achieved using a Form C relay 66 and the Hall effect current sensor 62.

The CPI electronics, including the relay, the Hall effect sensor and toroid, are encapsulated in a small housing 90. A connector 92 such as an RJ-45 is mounted on the top of the housing 90 for connection to the MicroLAN 50 (FIG. 1). Two rigid metal contacts 94 and 96 with an insulator 98 sandwiched between them protrude from the bottom edge of the housing 90. These are the two connections to the relay contacts 61 (FIG. 2). The bottom contact 96 has a larger radius hole than the top contact 94. An insulating washer 100 is first placed over the mounting stud 82. This insulating washer 100 has a cylindrical core around the stud 82 that prevents the ring terminal 102 from the field wiring 84 from contacting the mounting stud 82. The clearance hole in the CPI lower contact 96 is similarly sized to fit over another insulating washer 104 without contacting the mounting stud 82. The lower contact does make electrical connection to the ring terminal on the field wiring, either directly or through a washer. A nut 106 and a lock nut 108 are then used to tighten the CPI 48 to the mounting stud 82. The hole in the top contact 94 of the CPI is a clearance hole for the mounting stud 82 and centers the CPI 48 on the stud. The nuts 106 and 108 make direct electrical contact with the top contact 94 and the stud 82. The normally closed contacts 61 (FIG. 2) within the CPI 48 complete the circuit, using no external wiring. The connections are encapsulated, rugged, and reliable, and preserve the integrity of the vital circuit. When the relay is activated, the circuit is opened.

For track circuits, a normally open connection is required. The field connections for track circuits typically use two adjacent arrestor bases, one for each of the two wires to the rails. For this application, the CPI 48 may be mounted on one of the arrestor bases 88. A short wire from the normally open CPI relay contact is then connected to the stud on the adjacent arrestor base using a standard ring terminal. Since this is a normally open connection, no current or vital circuit signaling is carried by the wire. The isolation within the CPI is sufficient to keep any leakage below minimum requirements. The encapsulation further protects the components from any environmental contamination that might degrade the electrical isolation (increase leakage current). When the CPI relay is activated during test, the track circuit is shunted. This is the only time that any current flows through this wire connecting adjacent arrestor bases.

Figure 4:
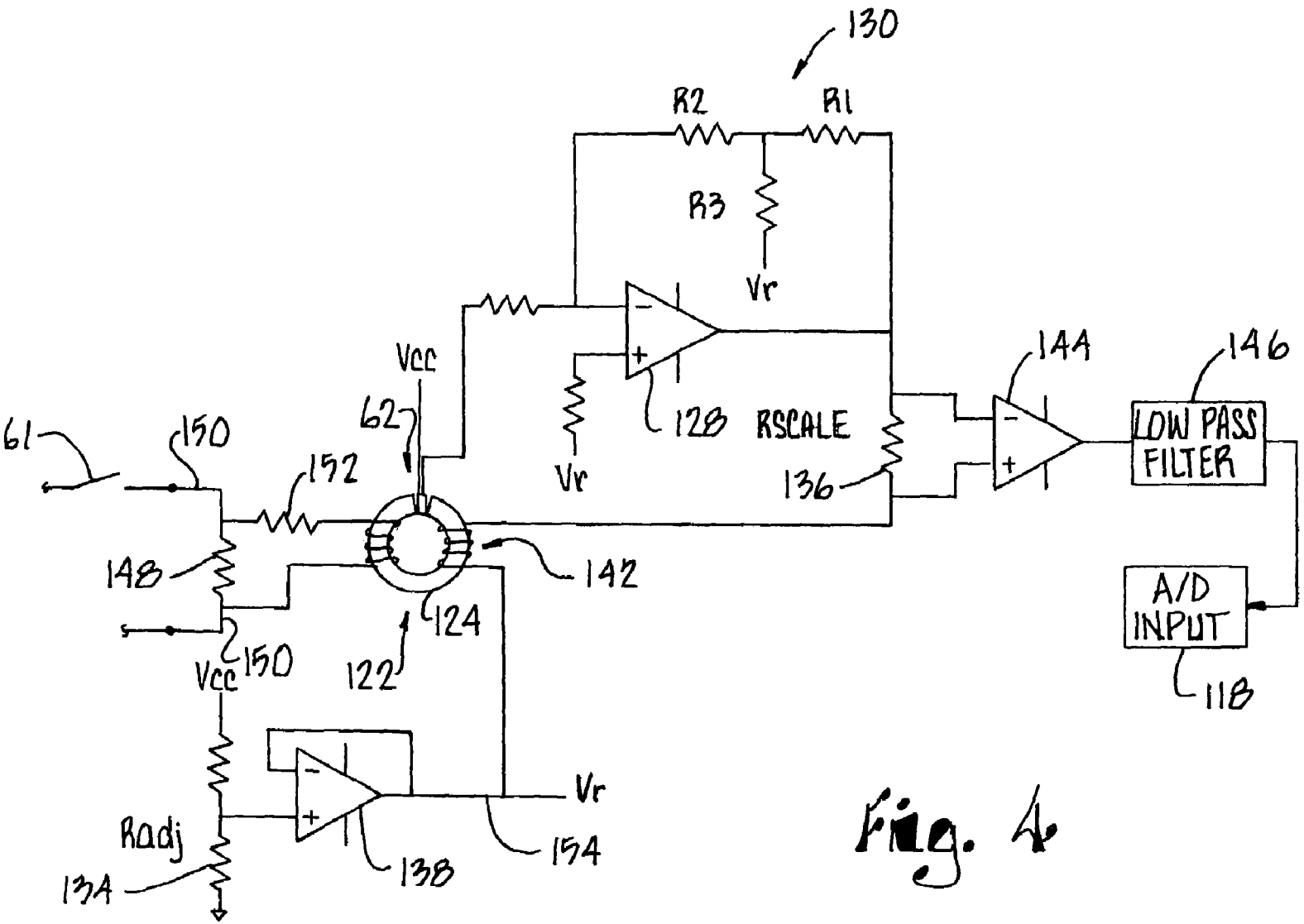
FIG. 4 is a current sensor circuit diagram for the control point interface.

Measurement accuracy is achieved through a circuit design shown in FIG. 4 that allows accurate current measurements over a wide range of currents. Different models of CPIs 48 may be configured for several current ranges, with relay contact ratings, selected components, and connection wire gauges appropriately chosen to minimize impact on interlocking circuits. Power CPIs are rated for 0 to 20 amps AC/DC for example. Signal lamp and track CPIs are rated for 0 to 5 amps AC/DC, for example. A third CPI is rated for 0 to 32 milliamps AC/DC. Additional ranges may be easily configured by sense resistor substitutions and amplifier gain changes.

In order to achieve the accuracy available utilizing an 8-bit analog to digital converter 118 (FIG. 4) in the microcontroller 64, the nonlinearities of the Hall effect sensor 62 are considered. The current being sensed by the CPI (FIG. 2) passes through the relay contacts 61 and an internal wire 70. This wire forms a sense winding 122 as shown in FIG. 4 by making several turns around a slotted ferrite core 124. The Hall effect sensor 62 is placed in the gap of the core 124 for maximum coupling to the flux in the core. The Hall effect sensor 62 has greater linearity close to zero flux. Therefore, the desired operating point is at zero flux.

The Hall effect sensor 62 is biased with a supply voltage 126, typically 5 volts, and operates at a quiescent (zero flux) output level near one half the supply voltage. The sensor 62 reacts to both positive and negative flux, and therefore operates around this quiescent point. An operational amplifier 128 is configured to operate as a voltage follower with a precision resistor divider 130 inputting approximately one half of the five volt power supply, or 2.5 volts. This low impedance reference (Vr) is used to null out the operational amplifier 128 offsets and the zero flux output level of the Hall effect sensor 62. A resistor Radj 134 is selected at factory test to so that no current flows through Rscale 136 at zero flux. The output of a buffer amplifier 138 is connected to a control winding 142 on the ferrite core 124 to the same voltage reference Vr. At zero flux, the output of the buffer amplifier 138 is near 2.5 volts, but the current through control winding 142 is zero. The buffer amplifier 138 has a high gain (approximately 9000) and drives the control winding 142 in a manner to drive the core flux to zero. A differential amplifier 144 with a gain of 1.5 is connected across Rscale 136 and followed by a low pass filter 146. The output of the low pass filter is converted by the analog to digital converter 118.

As current flows through the interlocking circuit being monitored, it flows through shunt resistor 148. The shunt resistor 148 is a stable precision resistor with Kelvin sensing connections 150. The sense winding 122 of the ferrite core 128 connects to these Kelvin leads 150. A series resistor 152 is selected to adjust the amount of current flow through the sense winding 122. This adjusts the magnetic flux developed in the core and thus adjusts the gain. The Hall effect device 62 senses the flux and produces an output from buffer amplifier 138 on line 154 that is applied to the control winding 142 in sufficient magnitude to drive core flux close to zero. The error flux is an inverse function of the loop gain, which includes the buffer amplifier gain (about 9000) and the control to sense turns ratio on the ferrite core 124. Since the quiescent point is biased at one half the supply voltage, positive or negative input currents are accommodated.

The result of this design is that the Hall effect device operates within a very small and highly linear dynamic range centered about zero flux. The high linearity significantly increases the linearity and accuracy of the current measurement system of the CPI 48.

Figure 5:
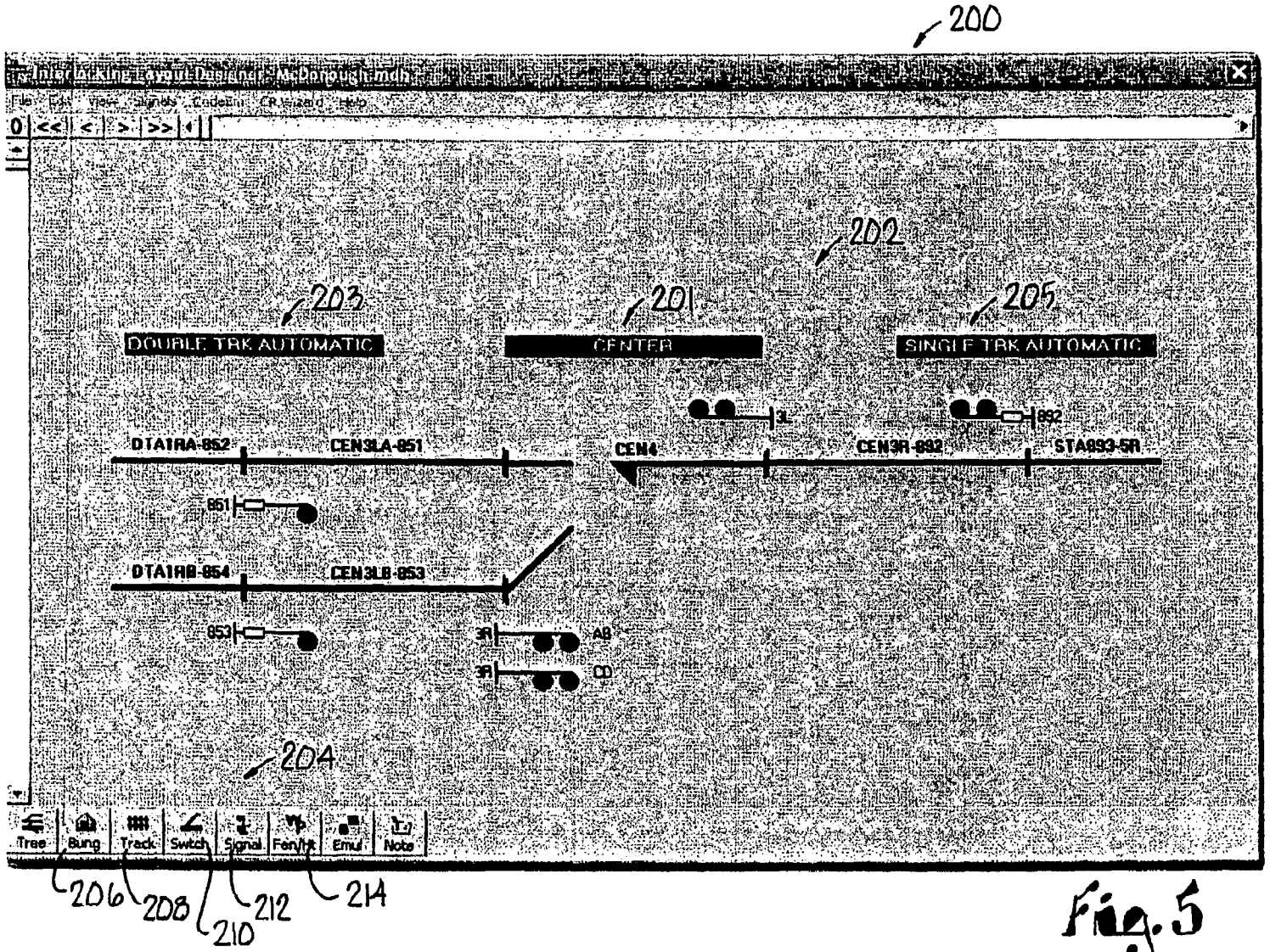
FIG. 5 is an interlocking layout design window.

Referring to FIG. 5, a typical end of siding layout is illustrated. The system test method begins by capturing the design of the interlocking and its relationship to adjacent control points. The design capture is implemented in software which runs under standard Windows® operating systems. In a graphic drawing window 200 components or objects 202 may be selected from a menu of objects 204 that are accessible through standard mouse and keyboard user entry methods. Component objects available to the user are Bungalows 206, Track Sections 208, Switches 210, Signals 212 and Slide Fences 214. As illustrated, the interlocking bungalow 201 is named CENTER, bungalows DOUBLE TRK AUTOMATIC 203 and SINGLE TRK AUTOMATIC 205 are control cases for automatic signals located on either side of the CENTER interlocking 201.

When an object 202 is selected from the menu of objects 204, a data entry window related to the object is opened. The user may then enter a name and other relevant information that characterizes the object 202. When the entry form is complete and the Save button is pressed, the data entry window is closed and replaced with a graphic image of the object 202. The object may then be dragged to a specific location on the graphic drawing 200 and positioned adjacent to other objects with which it is connected. The look and shape of the graphical images is similar to the standard symbology used by the railroad industry to diagram the interlocking design. Thus, railroad personnel familiar with interlocking design drawings and aspect charts are quickly able to construct a similar graphical image using the tools provided by the design capture software. The object name and other relevant information required for the data entry windows for each object are contained as annotations on typical interlocking design drawings.

The process may be accomplished by entering bungalow, code emulator, and CPI information first. Additional objects entered, such as tracks, switches, signals, and slide fences all require linking to Code Emulator Commands or CECs. These options are presented in a drop down list to the operator if the options have been previously entered into the program database. A method for capturing the design of an interlocking is described in the following paragraphs.

Figure 6:
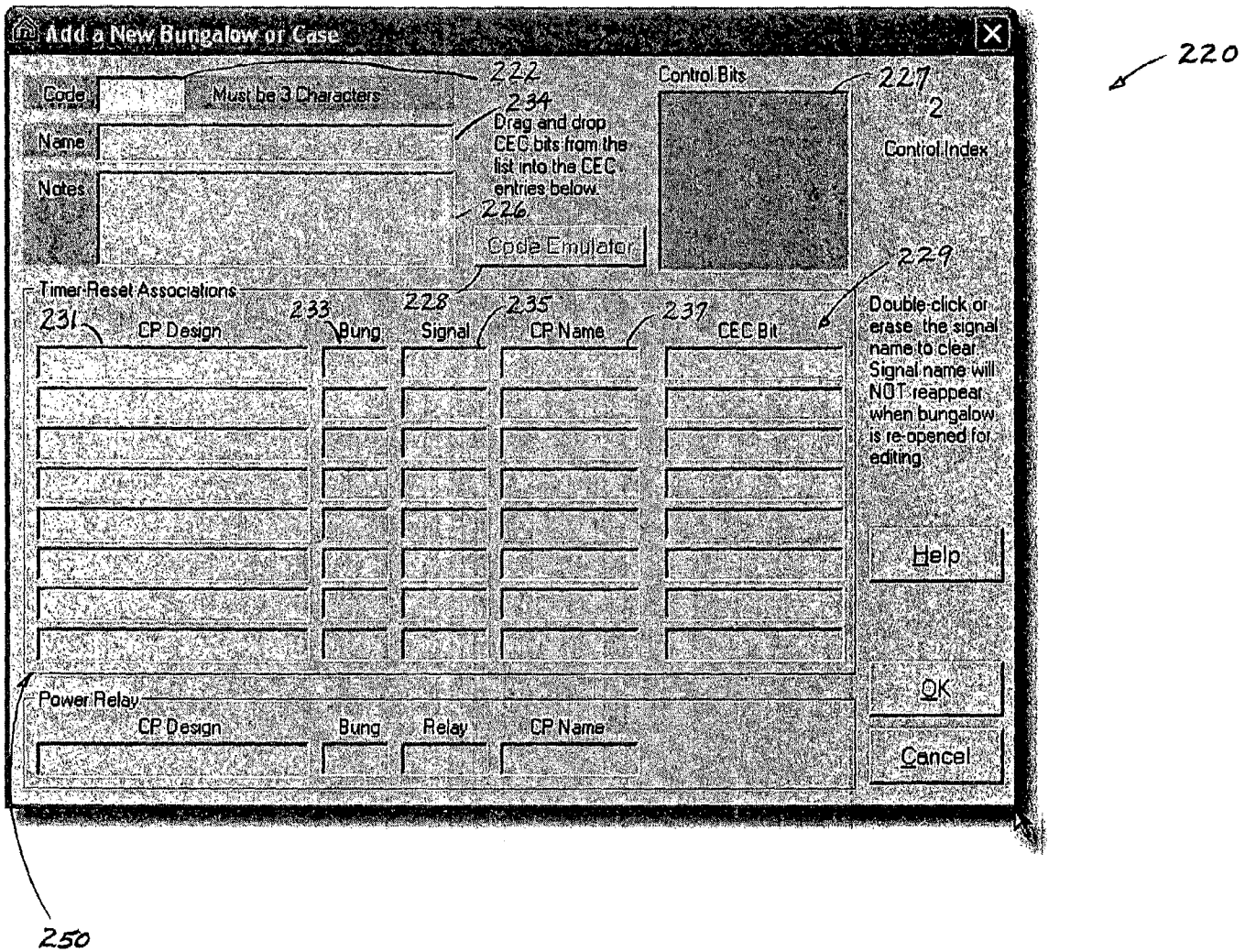
FIG. 6 is a data entry window for a bungalow object.

The design capture software is launched by double clicking on the program icon representing the software. A new file is then opened and named using standard Windows® conventions. The Bungalow object button 206 may then be selected. A data entry window 220 opens (FIG. 6), and the user enters a unique 3-character code for the bungalow in the box provided 222. This is usually the first three letters of the bungalow name, or other designation unique within the system database. The bungalow name and any comments may then be entered in boxes 224 and 226 respectively. If the CECs for this bungalow have been defined and command and indications bits assigned, they will be displayed in the Control Bits box 227. The command and indications bits may then be selected, dragged and dropped into the appropriate CEC Bit field 229. The CP Design fields 231 may be populated from the CP wizard, the Timer-Reset CPIs 250 are assigned, an association with a bungalow is defined in the Bung field 233, a signal association is defined in the Signal field 235, and a CP name is assigned in the CP Name field 237.

Timer reset CPIs 250 are entered by first entering the name of a signal associated with the AS relay to be used for the reset function. The CPI type is then selected from the drop down list. Then the associated Code Emulator command bit is dragged in from the selection field. The power relay to remove AC bungalow power during the test is also entered, choosing the relay type from a drop down list of CP types.

Figure 7:
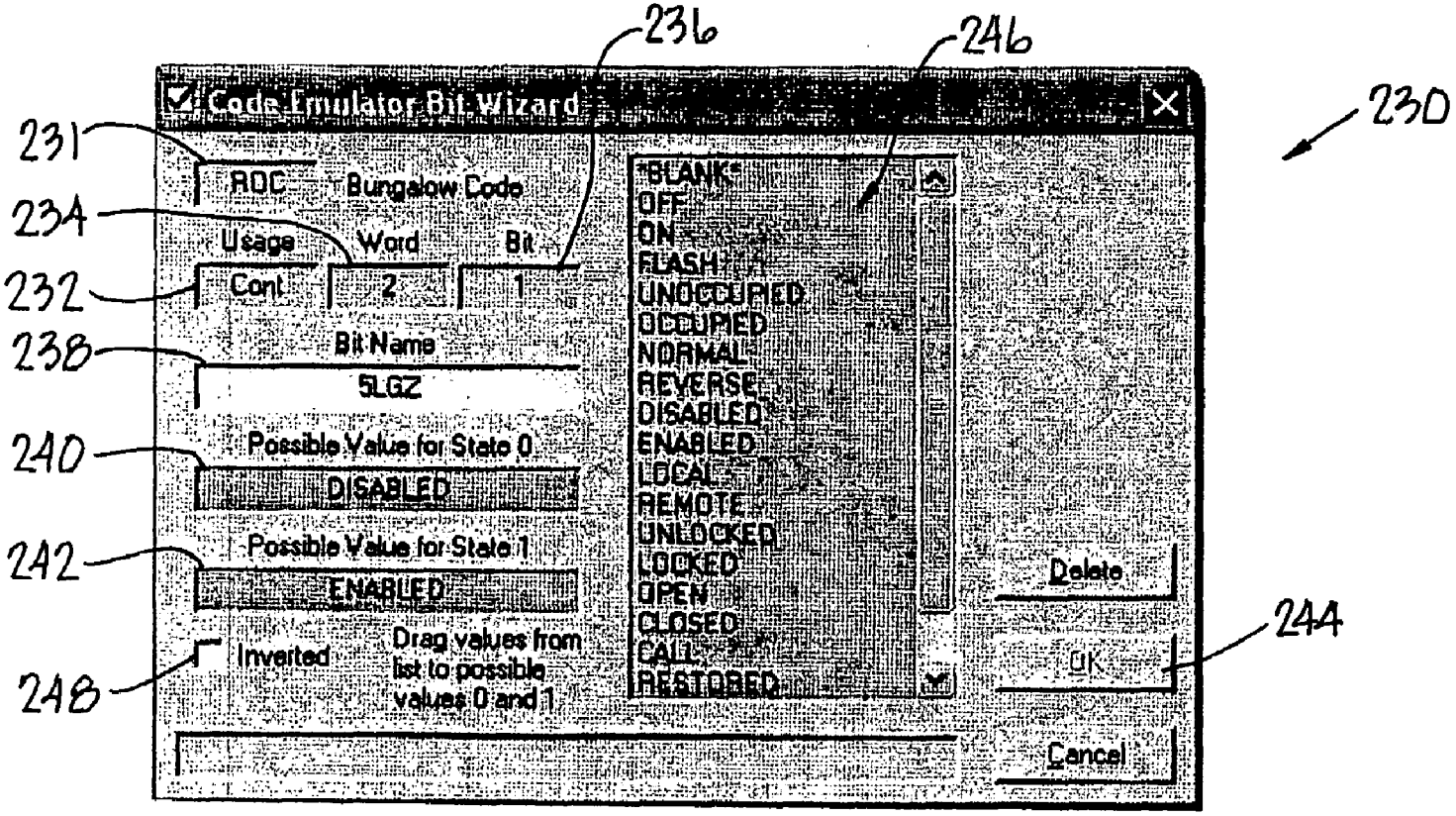
FIG. 7 is a code emulator bit wizard window.

The Code Emulator information is entered next by clicking the Code Emulator button 228 which causes the Code Emulator Bit Wizard window 230 to be displayed (FIG. 7). The Code Emulator button 228 is initially not active until a unique 3-character code is entered into box 222. Code Emulator commands and indications are entered by Word 232 and Bit position 234 in the data entry windows 236. Bit names are entered 238 and allowable states (such as ON, OFF, CLEARED, RESTORED) are dragged from the pick list 246 into place for each command bit 240 and each indication bit 242. When all necessary data is entered, the data is saved to a database by selecting the OK button 244.

The code emulator is the communications module used to control the interlocking from a remote location. InterTest connects to and communicates with this emulator via a serial communications port. Input into the code emulator object in the software includes entering the bit pattern for command words, and indication words.

The Code Emulator Bit Wizard 230 can be used to enter information for commands and indications for the code emulator. The code emulator is associated with a bungalow, and the bungalow code is entered into the Bungalow Code field 231. Usage 232, Word 234, and Bit 236 fields define whether the bit is for control or indication, which word it belongs to, and which bit of the word is being defined. The Bit name is defined in the Bit Name field 238, and possible states for the bit are dragged from the list box 246 and dropped in the State 0 240 and state 1 fields 242. If the bit type is inverted logically, the Inverted check box 248 is checked.

Bungalows for the adjacent interlocking sites (or control cases for the adjacent control point sites) are then entered. Each is positioned on the graphical drawing in its relative geographic position (FIG. 5).

Figure 8:
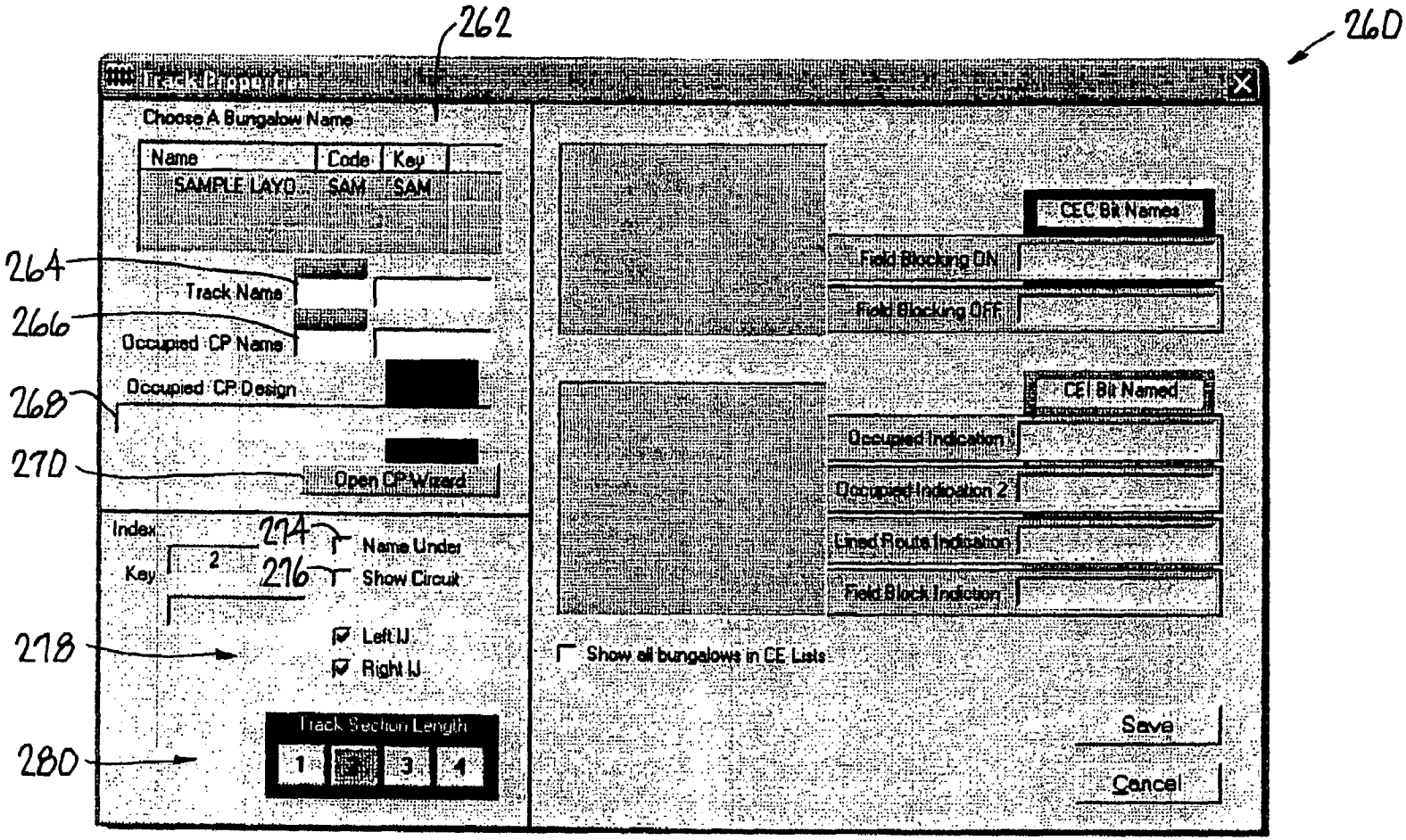
FIG. 8 is a bungalow code emulator window.
Figure 9:
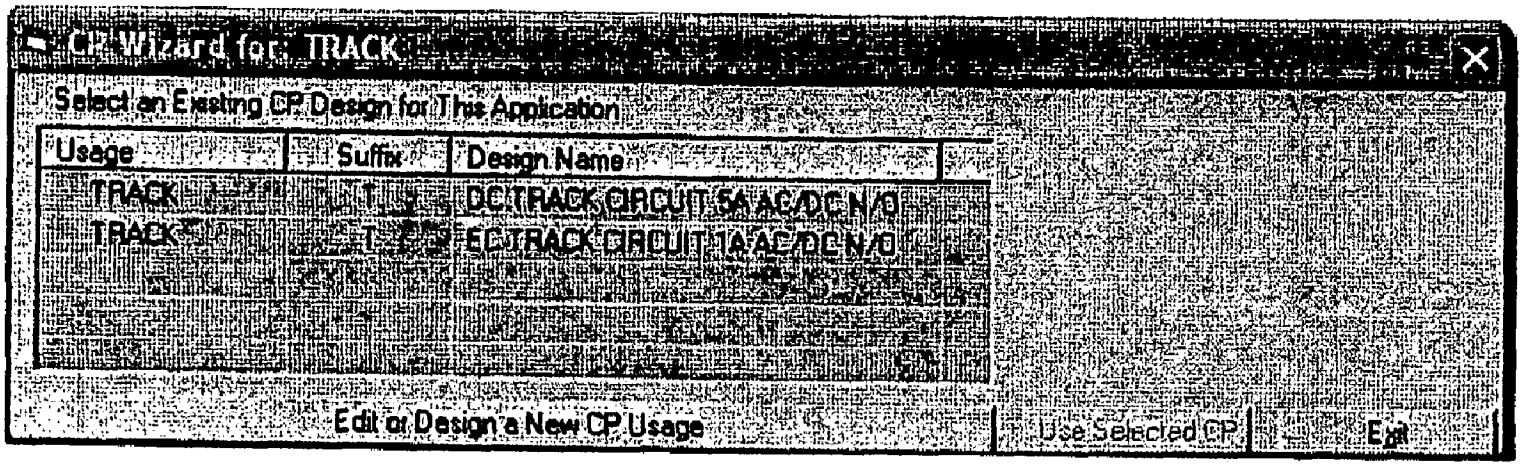
FIG. 9 is a track CP wizard window.

Tracks, switches, signals, and slide fences are then entered in any order desired by the user but preferably in the order listed. Selecting the Track button 208 (FIG. 5) causes the Track Properties window 260 to display FIG. 8. Track sections are entered into the program and characteristics such as length, whether or not the ends contain insulated joints, track name, and association to a bungalow are entered. Control Point Interfaces are also assigned. Track association with a bungalow is entered by selecting the bungalow name from the name list 262, track name is entered into the Track Name field 264, and the track occupancy CP name is entered into the Occupied CP name field 266. The occupied CP design 268 is entered by opening and selecting from the track CP wizard by selecting the Open CP Wizard button 270, which causes the track CP Wizard window 272 display, FIG. 9. Check boxes for enabling showing of the circuit name 274 and placement of the name above or below the track 276 can be selected. Check boxes to determine placement of insulated joints 278, if any, may also be selected. Track section length is selected by clicking one of the four track section length buttons 280. Code emulator commands and indications are dragged from the list boxes and dropped into the appropriate fields.

Figure 10:
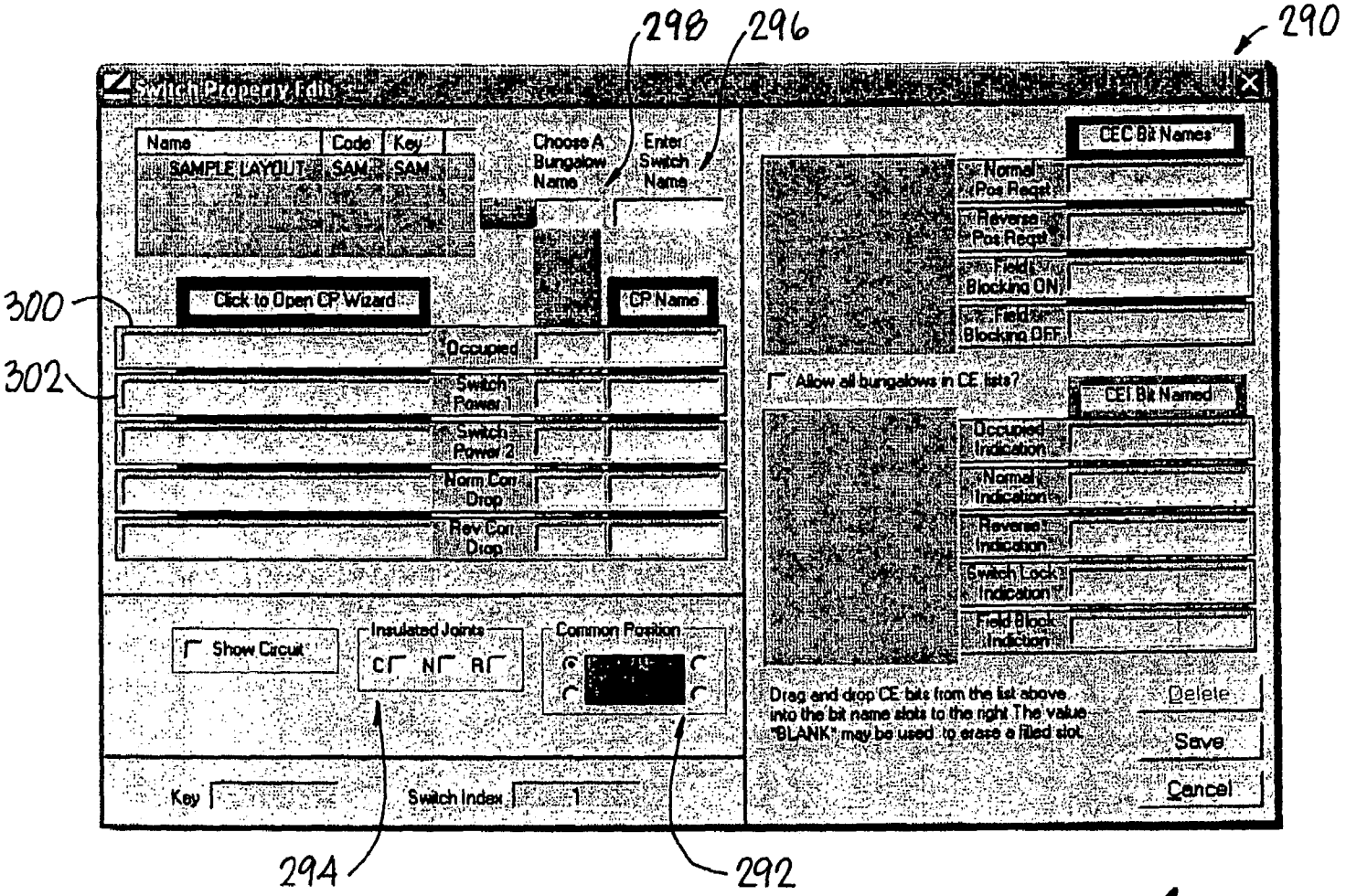
FIG. 10 is a switch property window.

Selecting buttons 210 (FIG. 5) causes the Switch Property window 290 to display, FIG. 10. Switches are entered into the program and characteristics such as orientation 292, whether or not the ends contain insulated joints 294, switch name 296, and association to a bungalow are entered 298, for example. Control Point Interfaces are also assigned for track circuit 300, and switch motor power 302. Commands for switch position and indications for switch positions are defined from the information entered into the code emulator.

Figure 11:
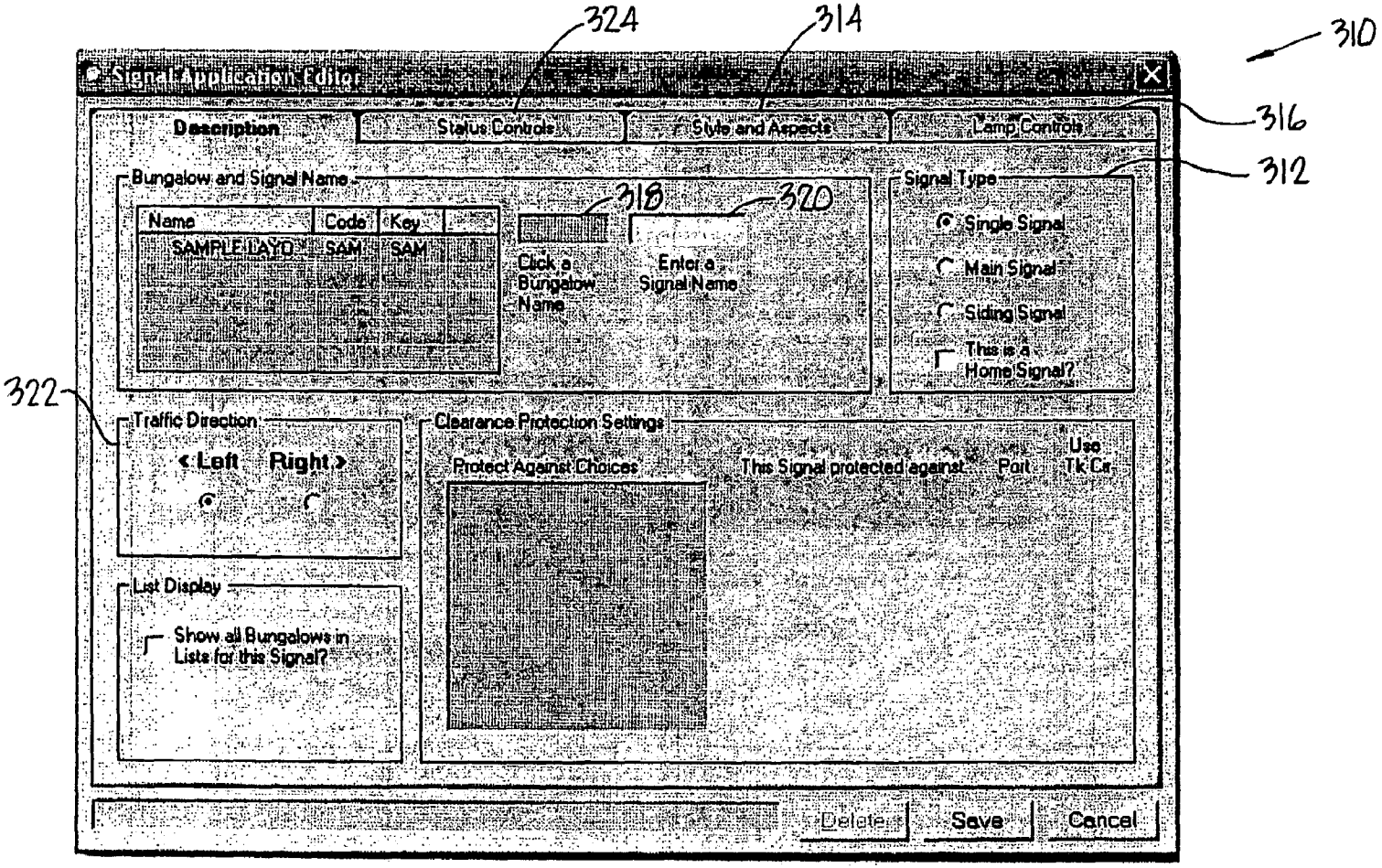
FIG. 11 is a signal application editor window.

Selection button 212 (FIG. 5) causes the Signals Application Editor window 310 to display, FIG. 11. Signals are entered into this window and signal characteristics are defined.

Figure 12:
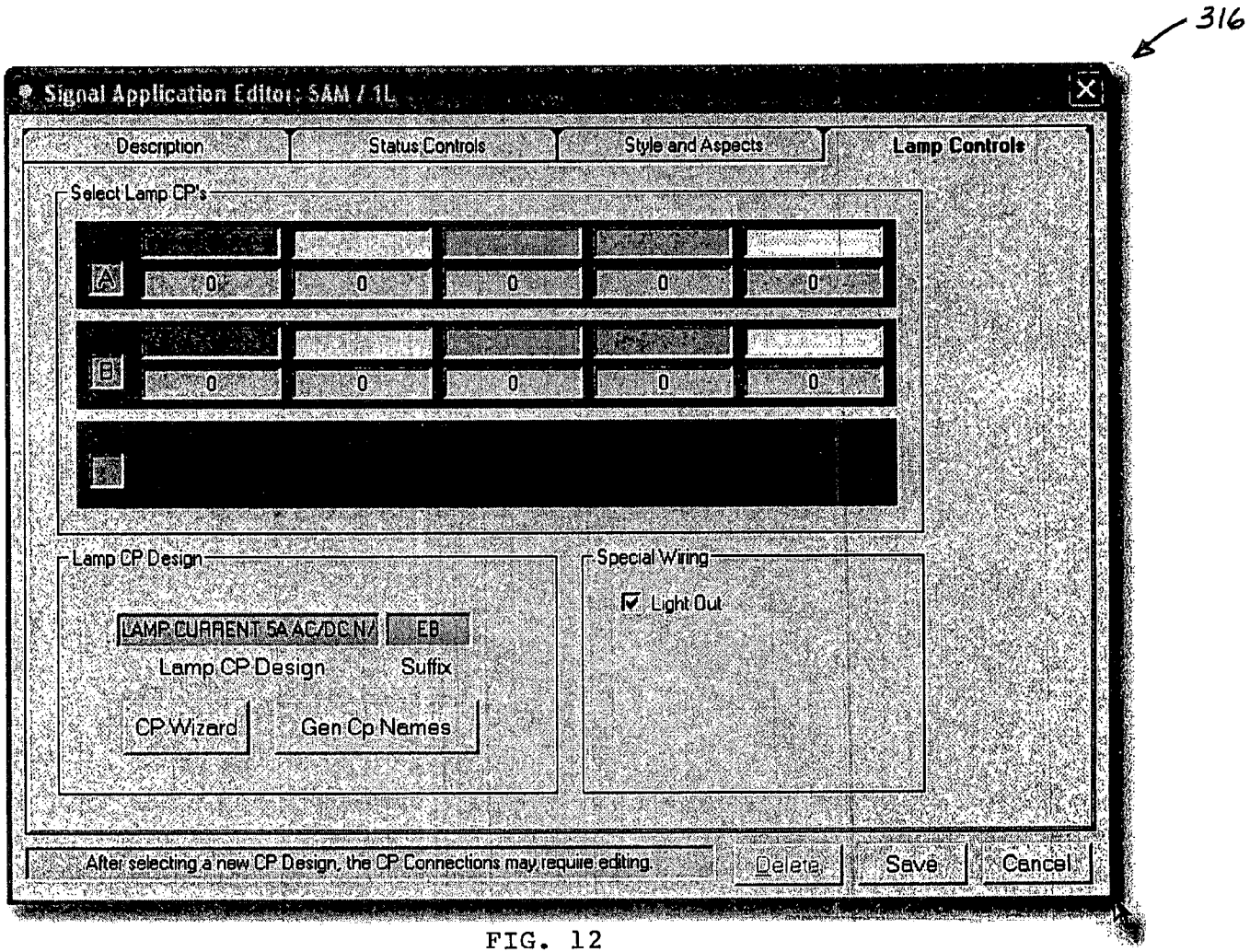
FIG. 12 is a lamp controls signal application editor window.
Figure 13:
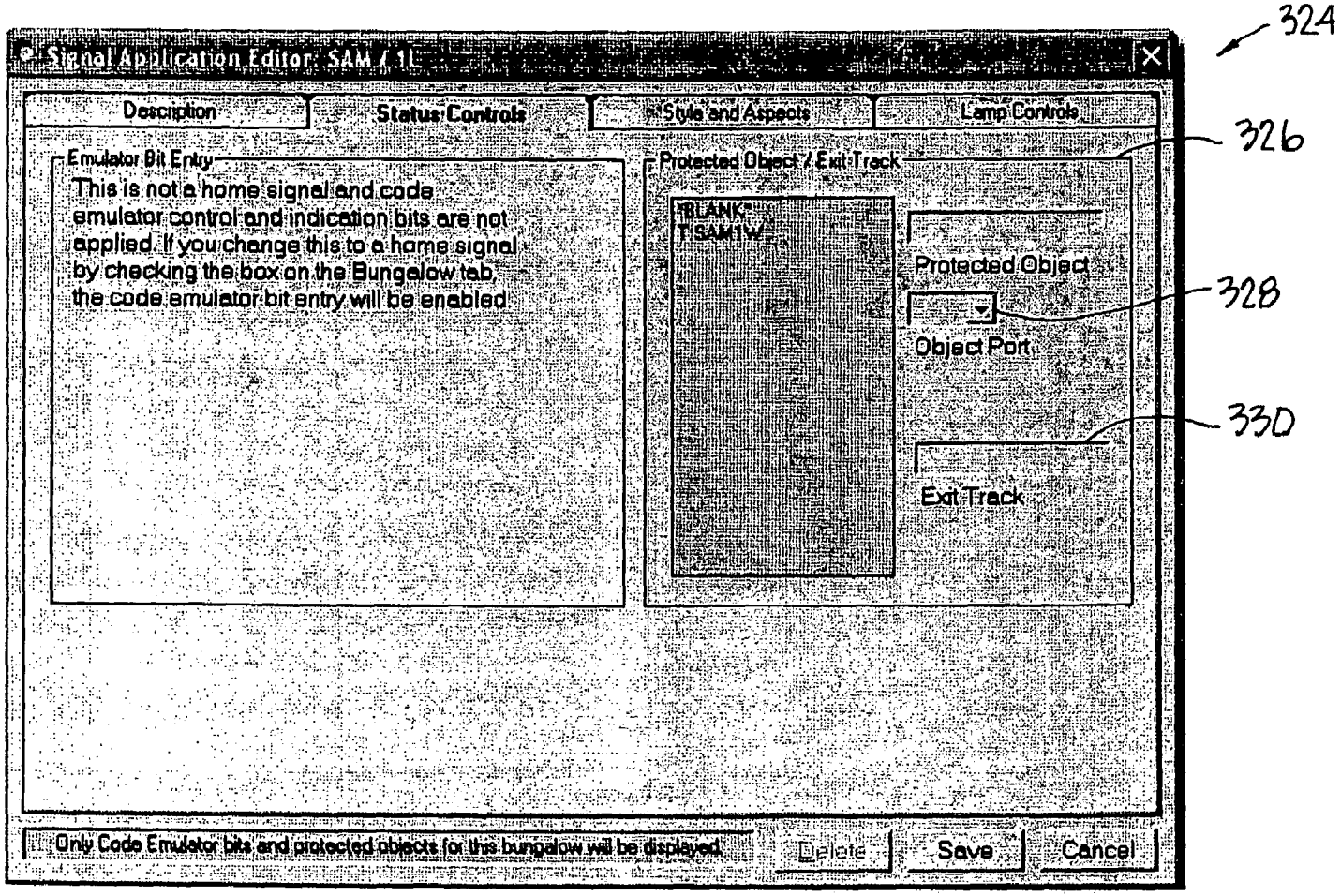
FIG. 13 is a status controls signal application edit window.
Figure 14:
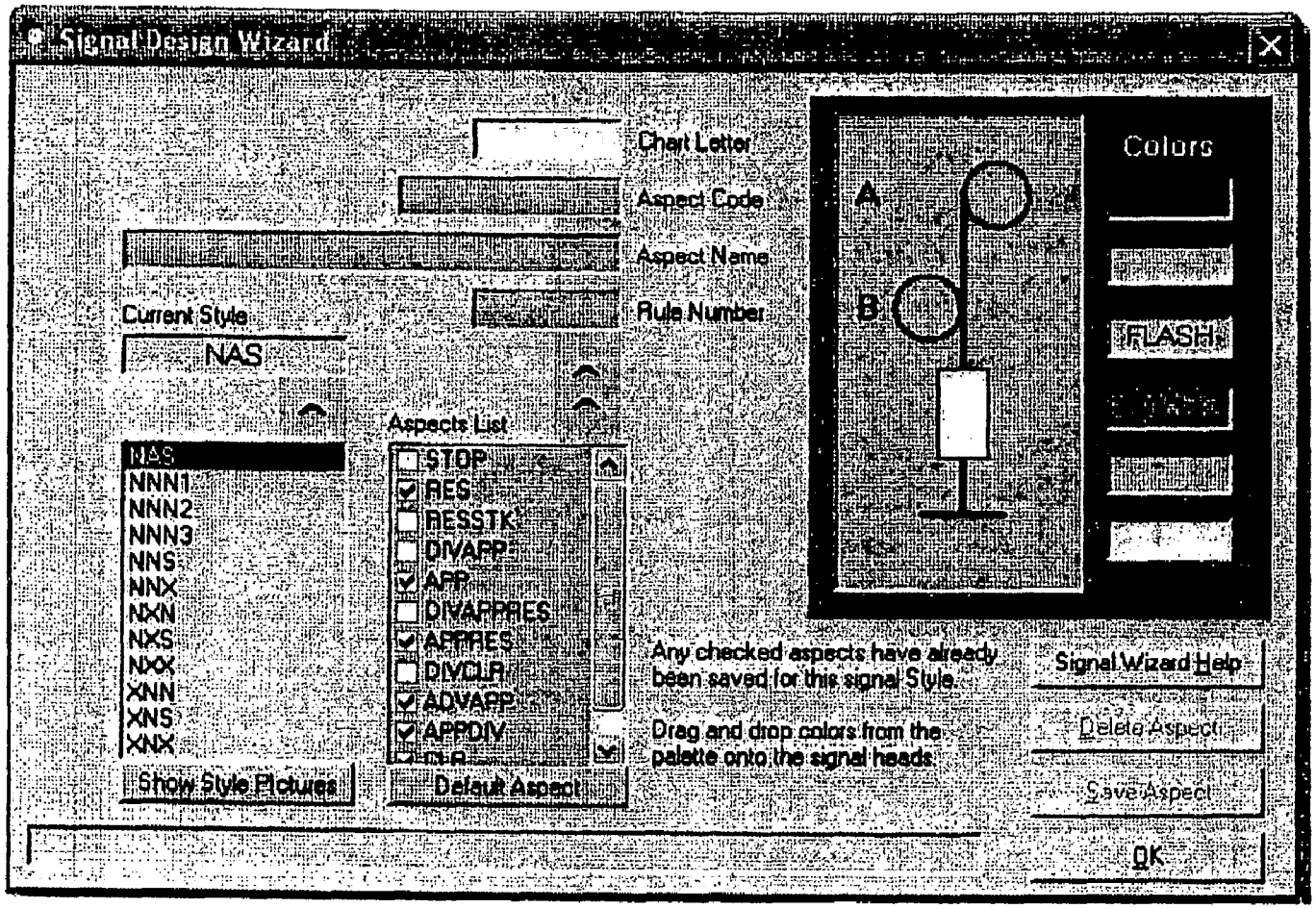
FIG. 14 is a signal design wizard window.

Signal characteristics include signal type 312 (home signal, automatic signal), signal style 314 (number of heads), colors or aspects the signals can display 316 (FIG. 12), associations between the protected object (the track circuit in front of the signal), the approach track (track circuit approaching the signal), and the association with other signals. The signal is defined in the description window of the signal application editor. It is associated with a bungalow by clicking a bungalow name in the list box 318, and a name for the signal is entered into the Name box 320. The signal type is defined by clicking the appropriate type box 312, the traffic direction is defined by clicking the Left or Right box 322. The Status Controls screen 324 (FIG. 13) allows definition of the protected object 326 (normally a track circuit or a switch), the port if the protected object is a switch 328, and the name of the exit track 330. These items are chosen from the list box, dragged and dropped into the appropriate field. The signal style is chosen from the list box of styles, and aspects that the signal can display are clicked in the Aspects list. Aspects now shown in the list may be defined by dragging colors onto the signal graphic and saving by opening the signal wizard 332 (FIG. 14).

Each object is given the unique name used on the railroad diagram for the interlocking. The code name for the bungalow is prepended to the object names, since generic names are typically used under railroad convention. For example, the home signals at each interlocking are typically named 1 E and 1 W (for 1 East and 1 West). Prepending the bungalow code converts these to an easily recognizable and unique name (such as TAY1 E for Taylor signal 1 E and TEM1 E for Temple signal 1 E). Data entry forms allow selection of previously entered objects as required to define the relationships between the objects. For example, entering track objects first allows the protected track object to be selected from a drop down list when initially entering a signal. Otherwise, the signal object must be re-edited later after the track object is entered. Various signal types are selected from a list of previously defined signal types. Aspect indications for a particular instance of a signal are turned on or off from the default aspect configuration. For example, a given signal may display Advanced approach (yellow over yellow) in one instance and not in another. Clicking on the appropriate boxes on the data entry form configures each signal instance as necessary.

Referring to FIG. 5, all objects are positioned on the drawing 200 in accordance with their actual geographic relationship. Cartesian coordinates of their placement on the drawing will be used to determine the connectivity of adjacent objects in identifying the possible routes through the interlocking design. Once the model entry is complete, the drawing is saved.

Figure 15:
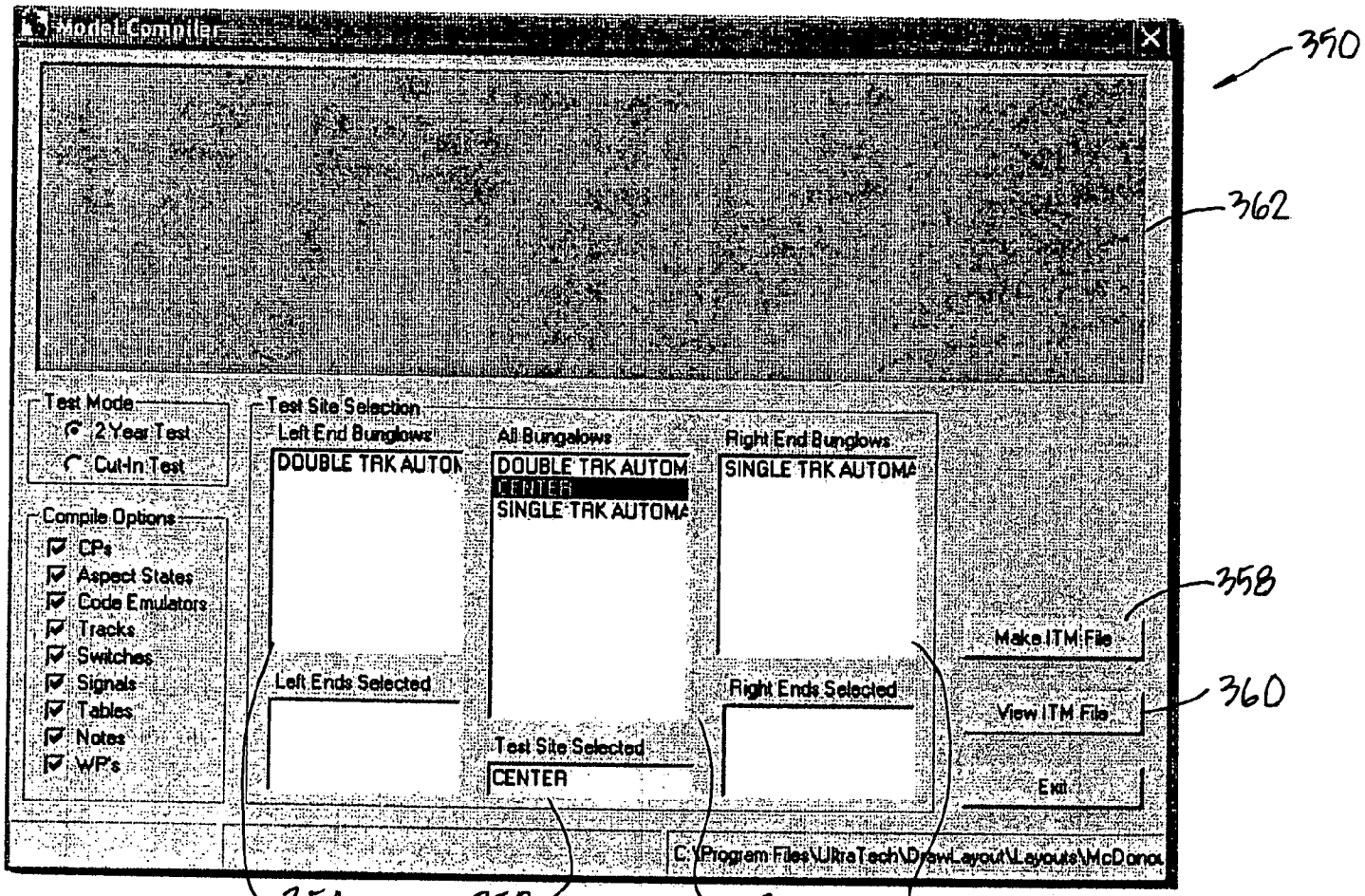
FIG. 15 is a model compiler window.
Figure 16:
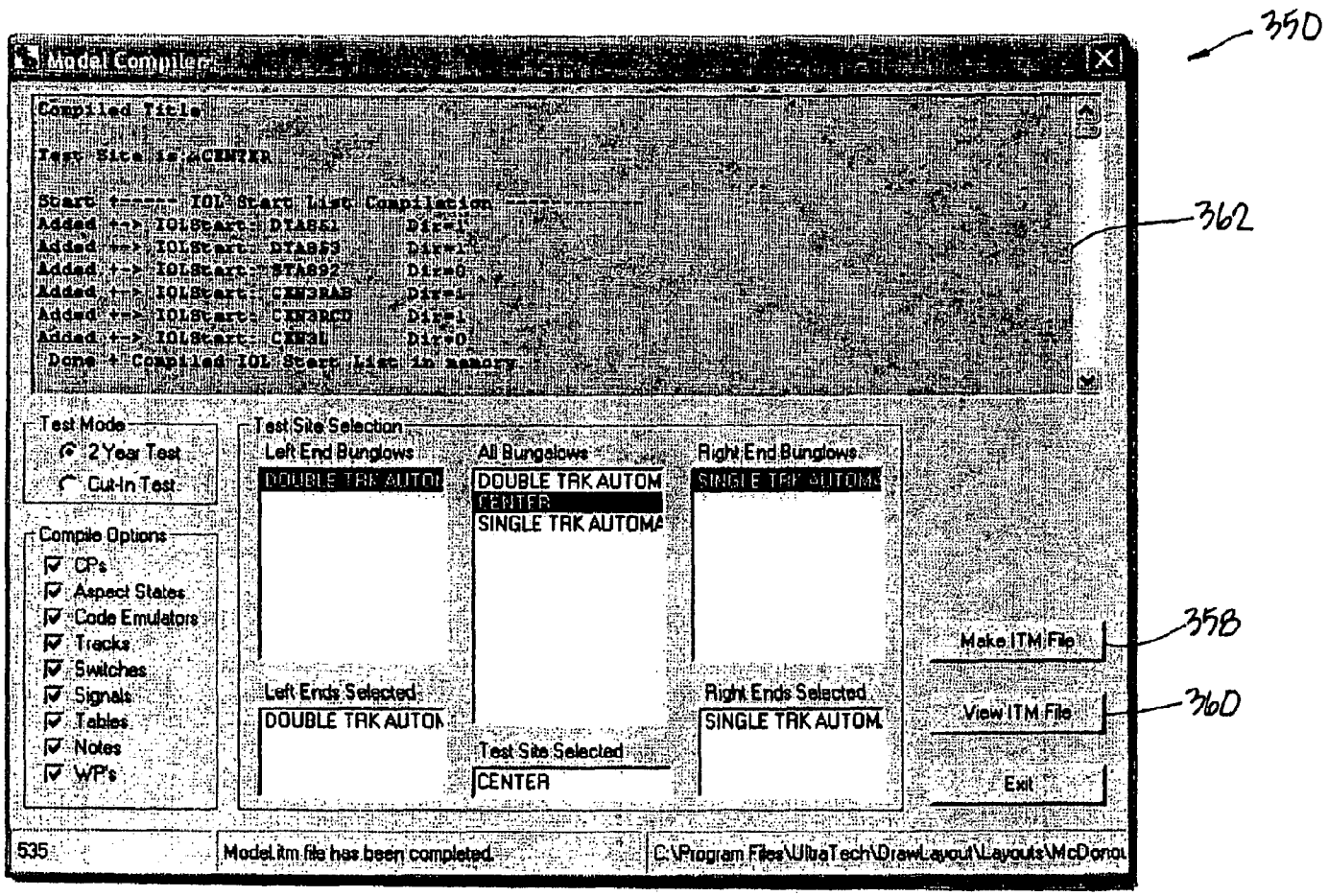
FIG. 16 is a model compiler window with a file loaded.

Referring to FIG. 15, after entering and defining all model objects, the next step in the process is to create a model.itm (item file) by initiating the model compiler. The test site 352 and end sites 354 are selected from the bungalows list 356, and then the compiler is started by clicking the Make ITM File button 358. The itm file is created by a software compiler which processes the defined model objects (FIG. 5) to define legal routes through the interlocking, and then all of the model objects on those routes. The model.itm file contains definitions of all assigned CPIs, tracks, signals, bungalows, switches, and code emulators. A signal aspect chart is derived from the model information as well as logic tables defining the logic and logical relationships of the interlocking. This model file is used to both create test procedures, and to perform actual testing of the interlocking. The content of the model.itm file may be viewed by selecting the View ITM File button 360 which displays the file in the upper window box 361 (See FIG. 16). This text file may be edited by an experienced user using any generic text editor program to address any unusual situations that may be incorporated in the interlocking design.

Specific items that may be edited are the signal aspect relationships. The default is to display a Clear (green) aspect before an Approach (yellow) aspect before a Stop (red) aspect.

Other aspects may be displayed depending upon the track configuration, distances that affect the ability to stop a train in time, and other safety considerations. Thus, signal aspects such as Approach Diverging, Advanced Approach, Diverging Approach Restricting, Approach Restricting, and others may be edited into the signal tables as required. Editing windows are provided to facilitate the editing process. More experienced users may use a text editor directly.

Figure 17:
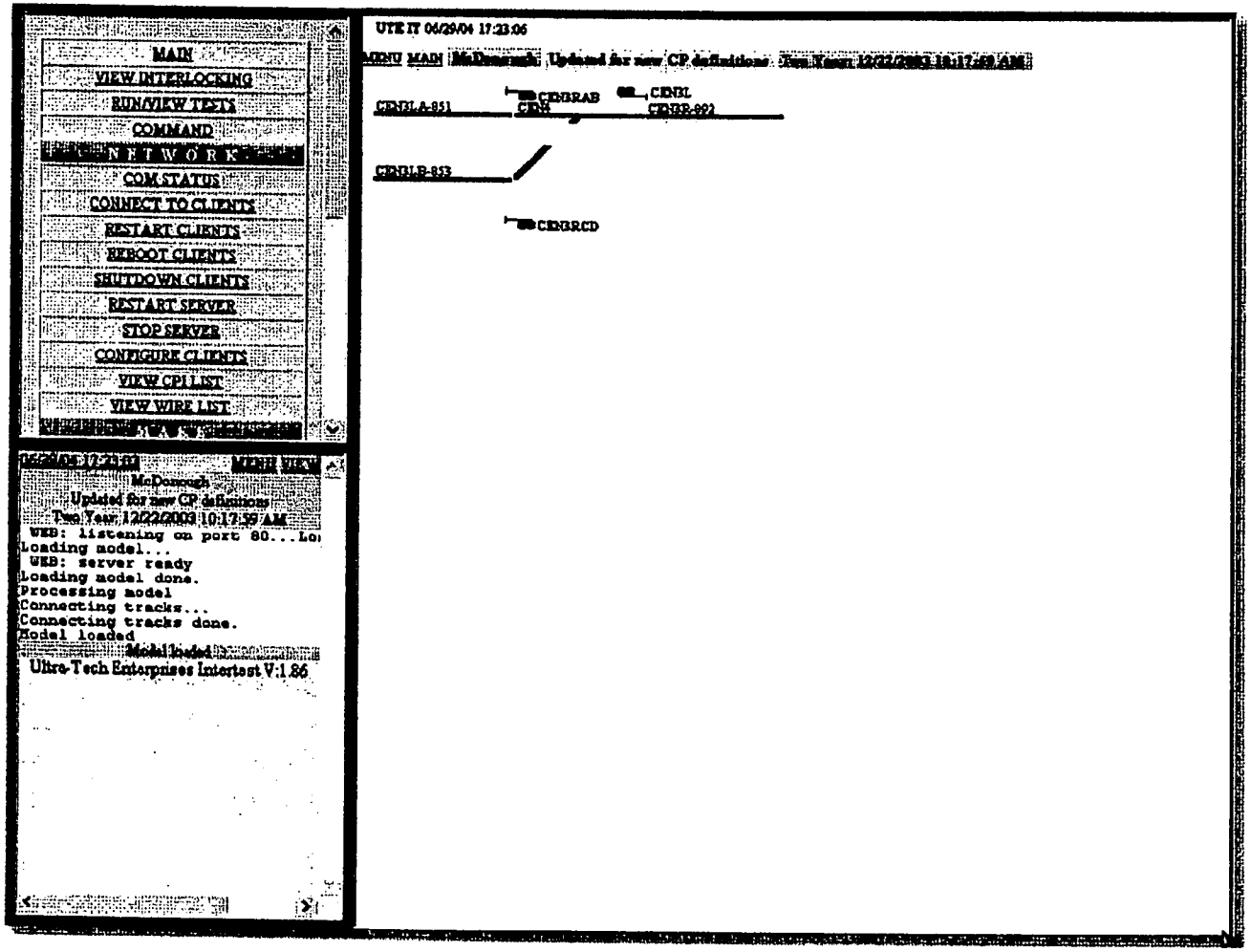
FIG. 17 is a run layout window.

Referring to FIG. 17, once the interlocking design has been captured, a second custom program named RunLayout is launched. The interlocking is loaded by selecting the model.itm file for the desired interlocking. RunLayout displays the same graphical design generated in the DrawLayout program. RunLayout generates a graphical image of the interlocking which is interactive with the actual measured state of the interlocking. The interlocking can be manipulated manually through commands in the program, signals can be lined, switches moved, track circuits occupied, etc. Each of these changes will be reflected on the computer screen as a change in track color for occupied tracks, and signals follow the color patterns actually seen on the signals.

Figure 18:
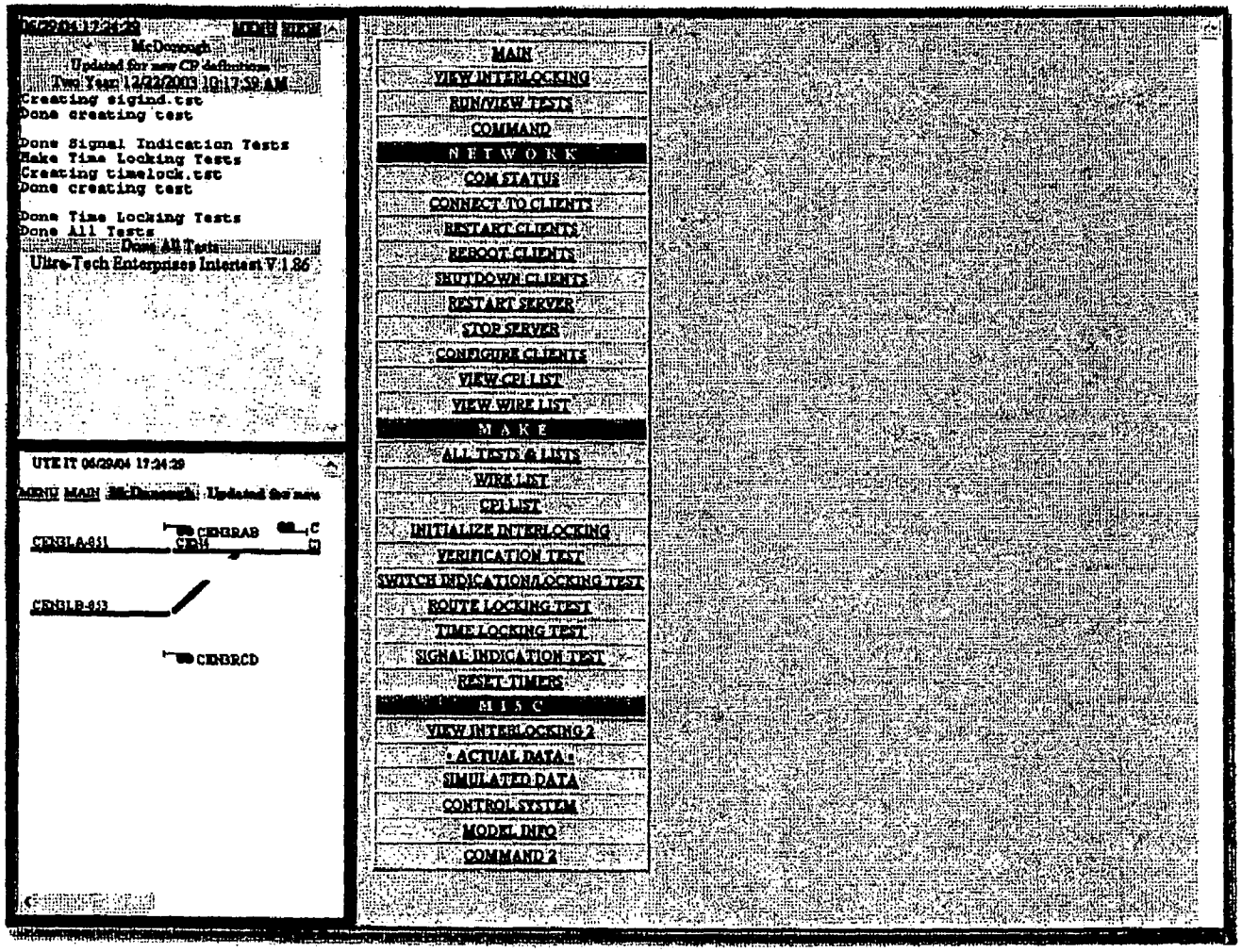
FIG. 18 is a model control selection window.

Referring to FIG. 18, menu selections are chosen to create test scripts. Test scripts are automatically generated by algorithms operating on the definitions in the model.itm file. The test scripts are text files using user readable statements that define the test stimuli and expected test results. These test scripts may be reviewed by the user as individual test types. Test types include Switch Indication, Route Locking, Time Locking, and Signal Indication. Test scripts may be edited to add or remove any conditions as desired by the user. Once the individual tests are acceptable, the user may elect to have the system combine them into a more efficient composite test. Rather than set up each condition necessary for a particular test, all possible tests are executed for each individual interlocking configuration. This approach minimizes switch movements and significantly reduces test time while executing all required tests.

Test procedures are generated by another compiler, and executing the command MAKE ALL TESTS AND LISTS, generates all required test procedures for testing the interlocking.

The menu block contains all of the commands in RunLayout: View Interlocking, RunView Tests, Command, Com Status, Connect to Clients, Restart Clients, Reboot Clients, Shutdown Clients, Restart Server, Stop Server, Configure Clients, View CPI List, View Wire List, Make All Tests & Lists, Make Wire List, Make CPI List, Make Initialize Interlocking, Make Verification Test, Make Switch Indication Locking Test, Make Route Locking Test, Make Time Locking Test, Make Signal Indication Test, Make Reset Timers, View Interlocking 2, View Simulated Data, Control System and Model Info.

Figure 19:
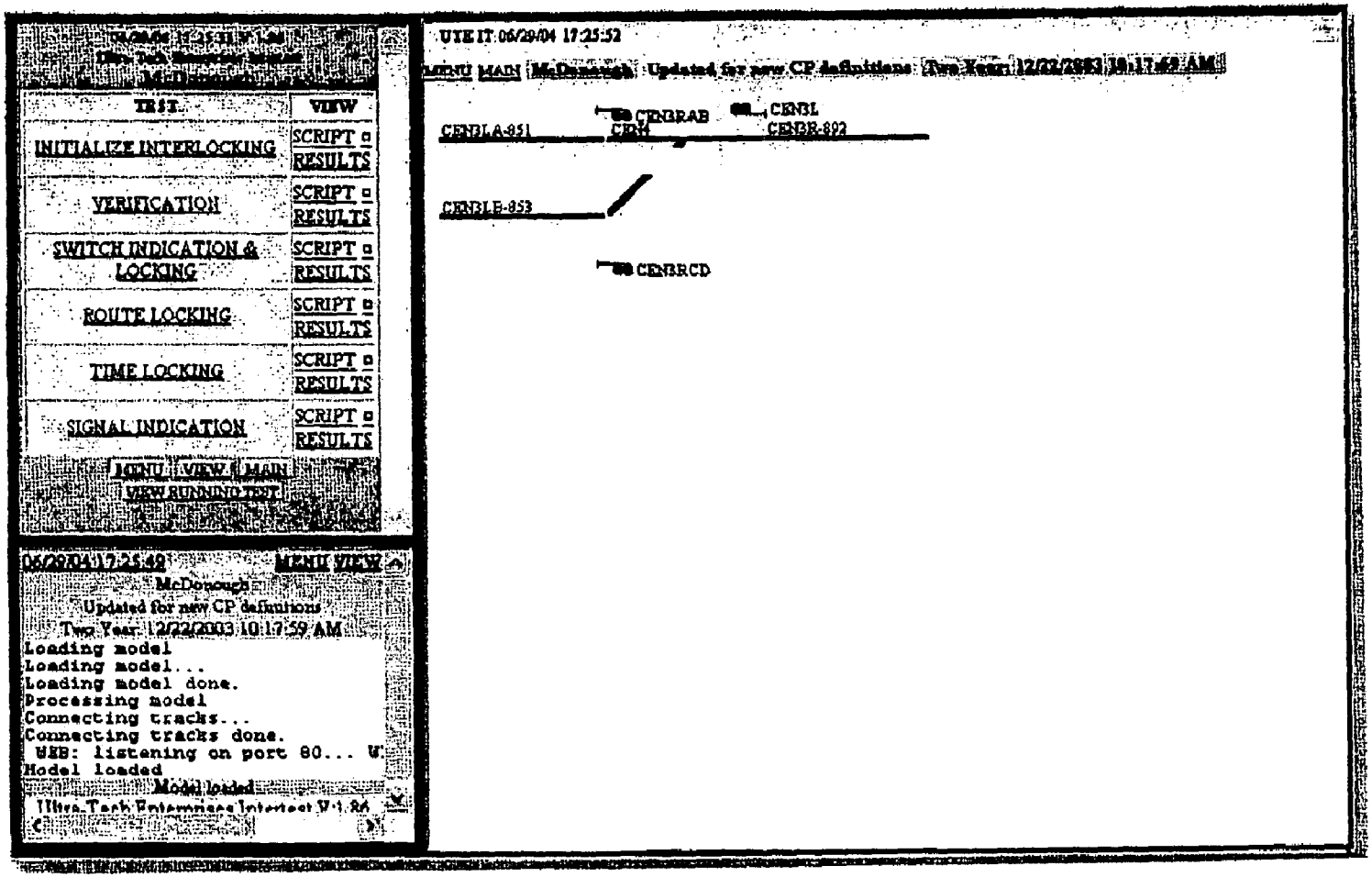
FIG. 19 is a model test screen window.

Referring to FIG. 19, before running the automated composite test (or the individual automatic tests), the equipment is set up and connected. Reports from the design capture identify the CPIs required and the connection points. Even if these were previously installed and used, they are verified in order to ensure a valid test result. A verification process accomplishes this. The RunVerification test is initiated as the first test once track time has been obtained. The PDA is used as the interface to the system, displaying operator commands and requesting data entry to indicate that requested actions have been accomplished or to enter visually observed test results. CPI operation and connection is verified by activating each CPI individually, visually observing the desired result, and electrically measuring the desired result where possible. This process is described in the following paragraphs.

The operator is first requested to visually verify that a switch is in the NORMAL position. System indications are measured to validate that they indicate the switch is in the NORMAL position. The switch is then commanded to move to REVERSE, and the operator is asked to visually verify that the switch is in the REVERSE position. System indications are again validated and the switch is commanded back to the NORMAL position. This process is repeated for all switches.

The test operator is then requested to shunt a specific track with the standard 0.06 Ohm track shunt. The system measures that the proper indication is received. The operator is then requested to remove the shunt. After receiving the message that the shunt is removed, the CPI is activated to shunt the same track and the proper indication is again validated. This process is repeated for all track circuits.

The operator is then directed to look at a specific lamp on a signal. The interlocking is configured by the server to set the lamp to a specific color, such as red. The user is requested to verify that the signal lamp is red and so indicates by a PASS/FAIL entry on the PDA. The current through the CPI on that lamp is then measured to validate that the current is above the threshold. The CPI relay is then commanded to open, and the operator is asked to visually verify that the lamp is dark. The CPI is also sampled to validate that the current is below threshold. The relay is again closed and the operator again verifies that the lamp is on. This process is repeated for each lamp color on each signal head on each signal.

Once RunVerification is completed, the system has verified that all CPIs are operational (both command and measurement functions) and are properly connected to the desired circuits. For example, the system has validated that when the CPI connected to the yellow lamp on the A head of signal TAY1W measures a current above threshold, lamp TAY1 WAY (A head, yellow lamp) is on. All signal aspects can then be accurately recorded by measuring the CPIs.

The automatic test(s) are then initiated, either as individual tests or as a composite test. Results are automatically recorded in the database for subsequent report generation. The graphic display is activated during the test to illustrate test progress, illustrating switch positions, track occupancy, and signal indications.

Figure 20:
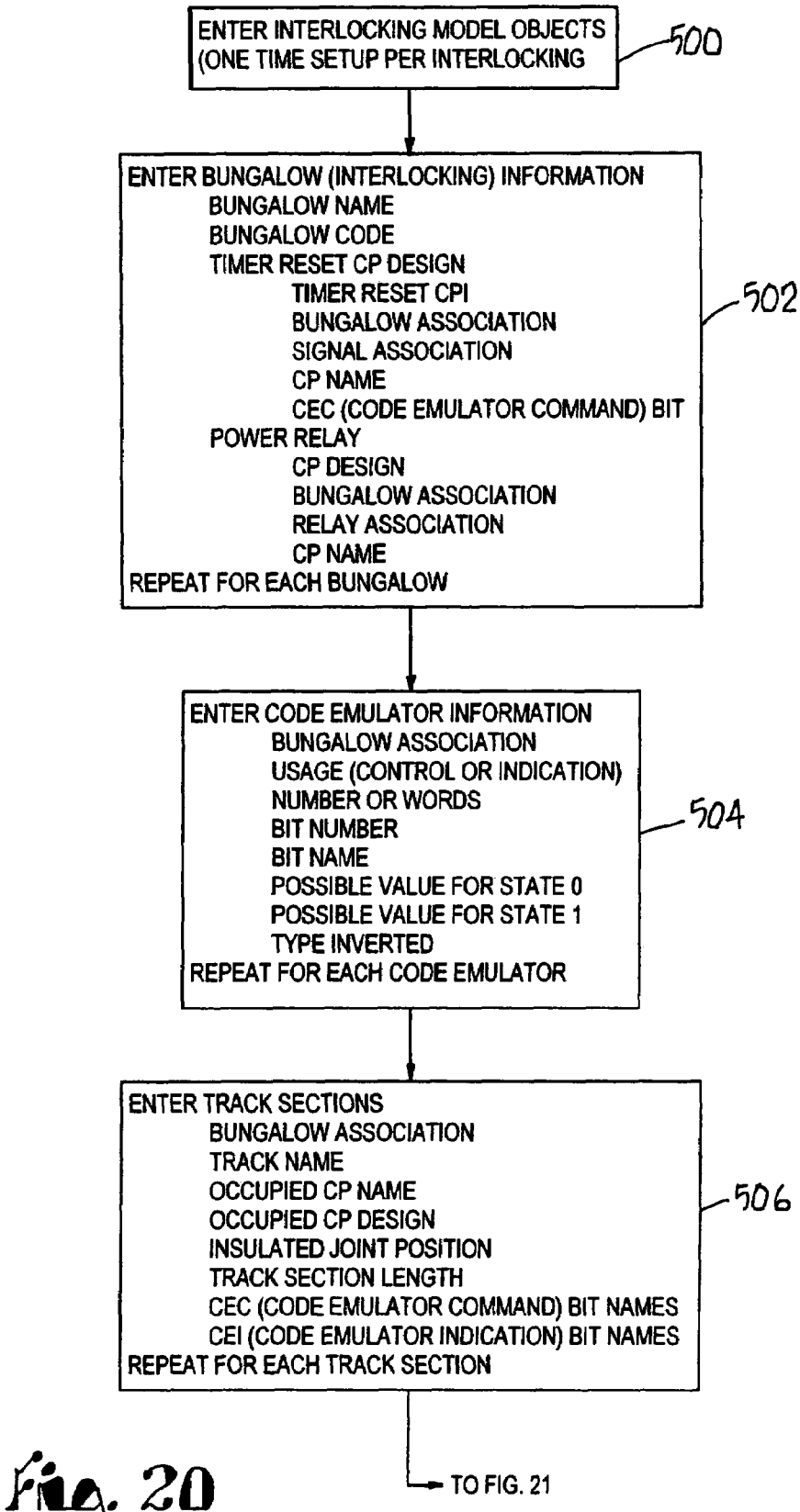
FIGS. 20, 21*a*, 21*b*, and 22 illustrate the software flow for setting up interlocking model objects.
Figure 21A:
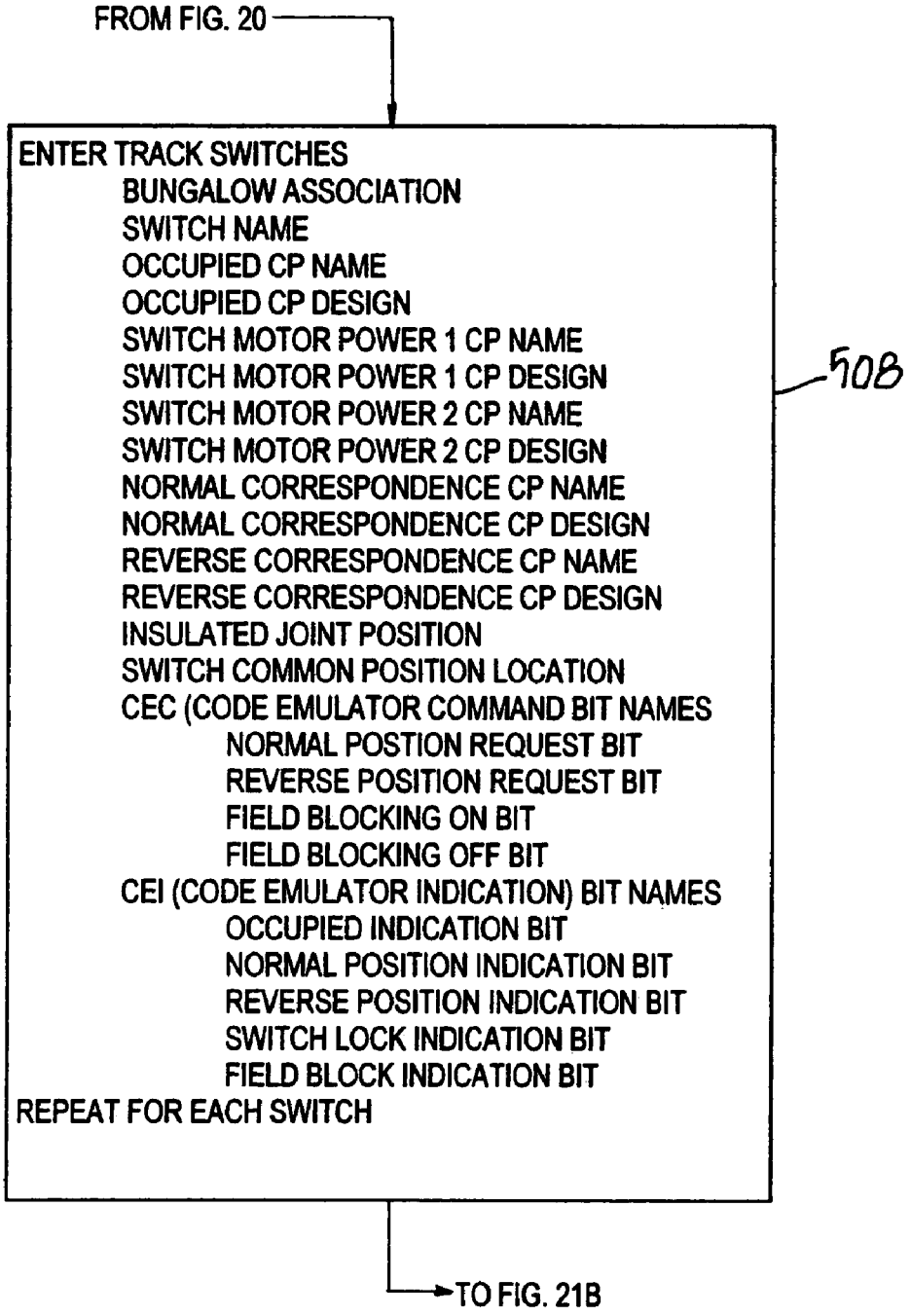
Figure 21B:
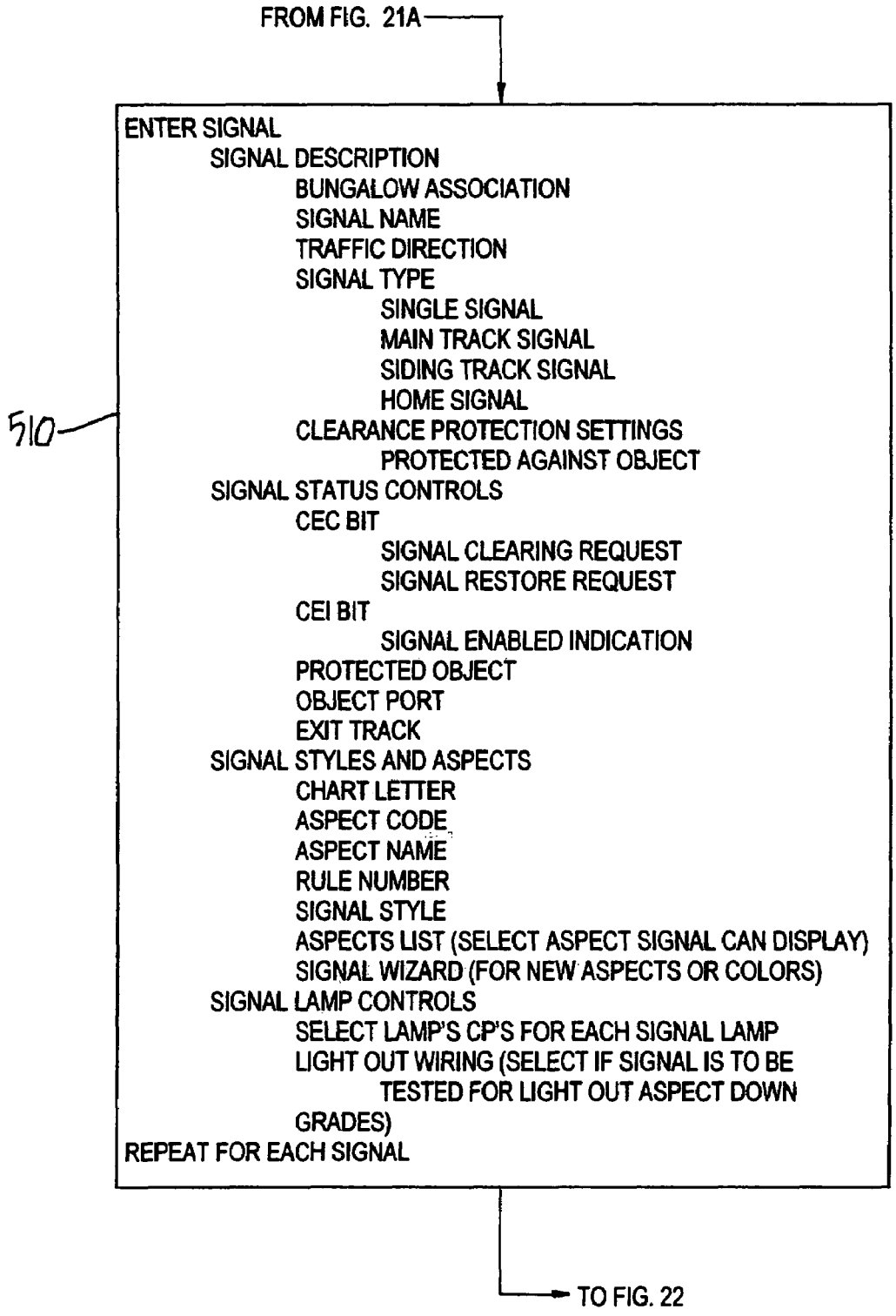
Figure 22:
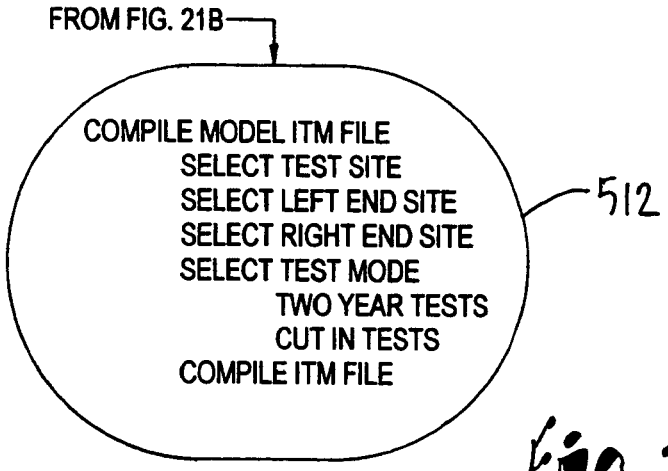

Referring to FIGS. 20-22, a block diagram of the interlocking setup software is illustrated. The setup of the interlocking begins by entering the interlocking model objects block 500. Information for each bungalow is entered, block 502, including bungalow name, code, timer reset CP design (timer reset CPI, bungalow association, signal association, CP name, CEC bit) and power relay (CP design, bungalow association, relay association and CP name). This step is repeated for each bungalow.

Next the code emulator information is entered, block, 504. For each code emulator, the bungalow association, usage, number or words, bit number, bit name, value for states 0 and 1, and if the type is inverted are entered.

At block 506, setup information for each track section is entered including bungalow association, track name, occupied CP name and design, insulated joint position, track section length, and CEC and CEI bit names.

The track switch information is entered for each switch at block 508. The track switch information includes bungalow association, switch name, occupied CP name and design, switch motor power 1 and 2, CP name and design, normal and reverse correspondence, CP name and design, insulated joint position, switch common position location, and CEC and CEI bit names.

Next the signal information is entered, block 510, which includes signal description and association bungalow name, signal name, traffic direction, signal type and clearance protection settings, signal status controls and associated CEC and CEI bits, protected object, object port and exit track, signal styles and aspects and associated chart letter, aspect code and name, rule number, signal style, aspects list and signal wizard, and the signal lamp controls with associated lamp CPs for each signal lamp and light out wiring.

Finally, the model.itm file is generated, block 512, by selecting the test site, left and right end sites, test mode of two year tests or cut in tests.

Figure 23:
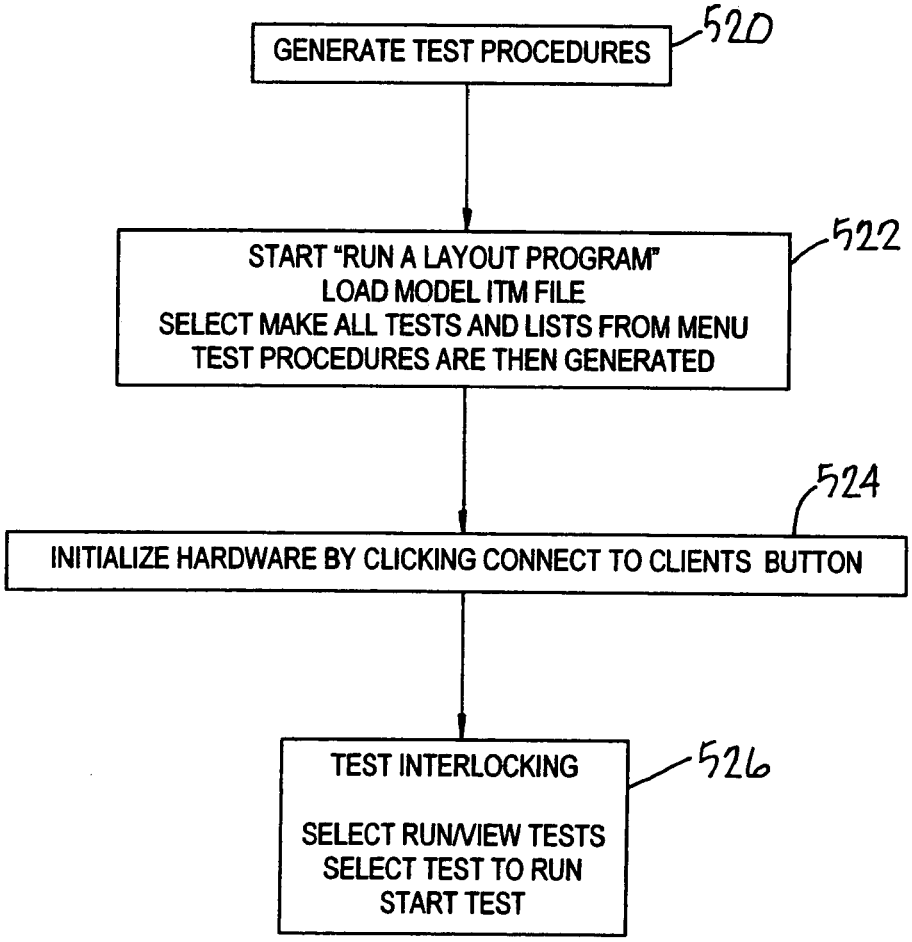
FIG. 23 illustrates the software flow for generating test procedures.

Referring to FIG. 23, the test procedures are generated, block 520, by loading the model.itm file into the run layout program and selecting all tests and lists to generate the test procedures, block 522. The client hardware is initialized, block 524, to test an interlocking by selecting the test to run and starting the test, block 526.

Figure 24:
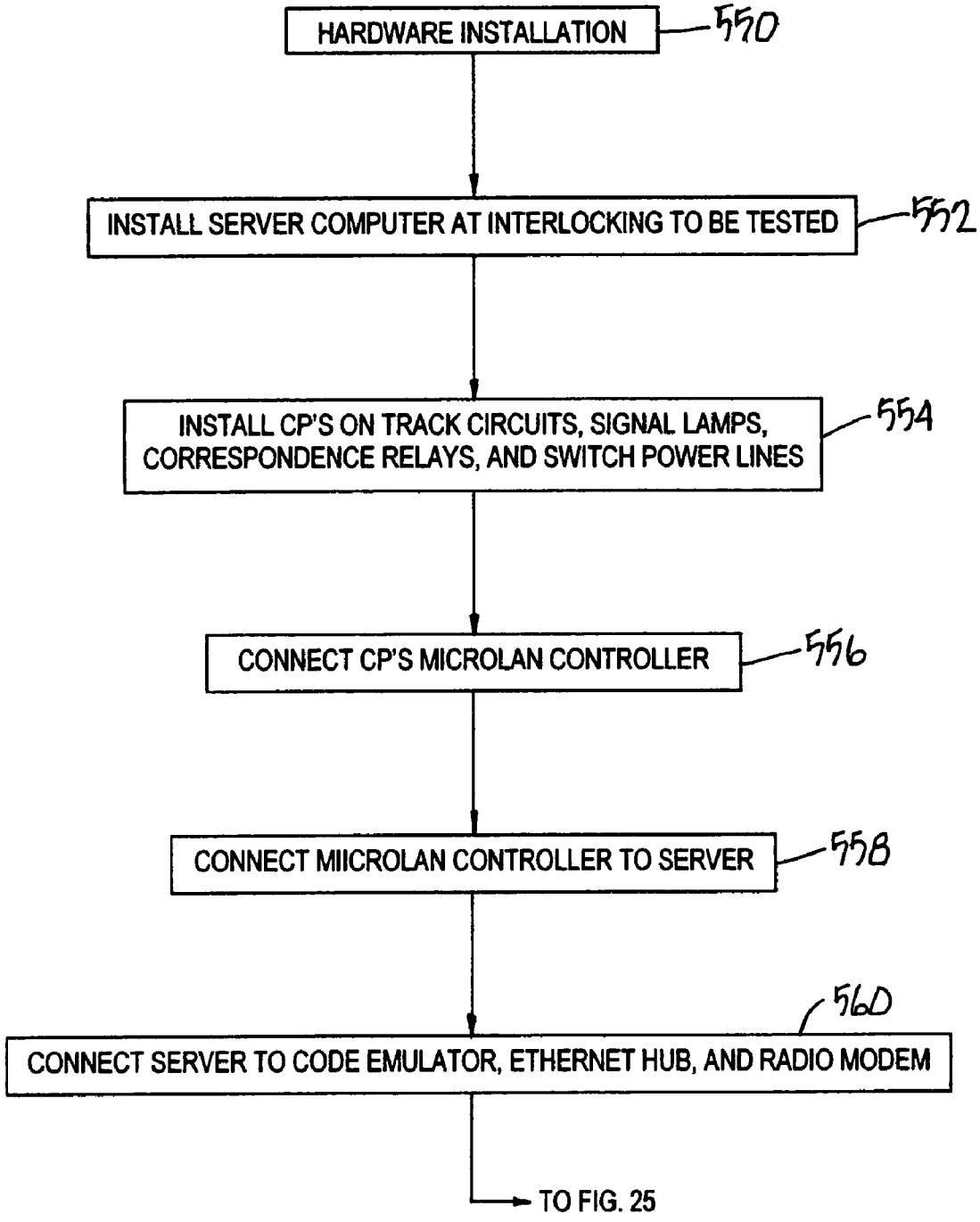
FIGS. 24 and 25 illustrate the hardware setup procedure.
Figure 25:
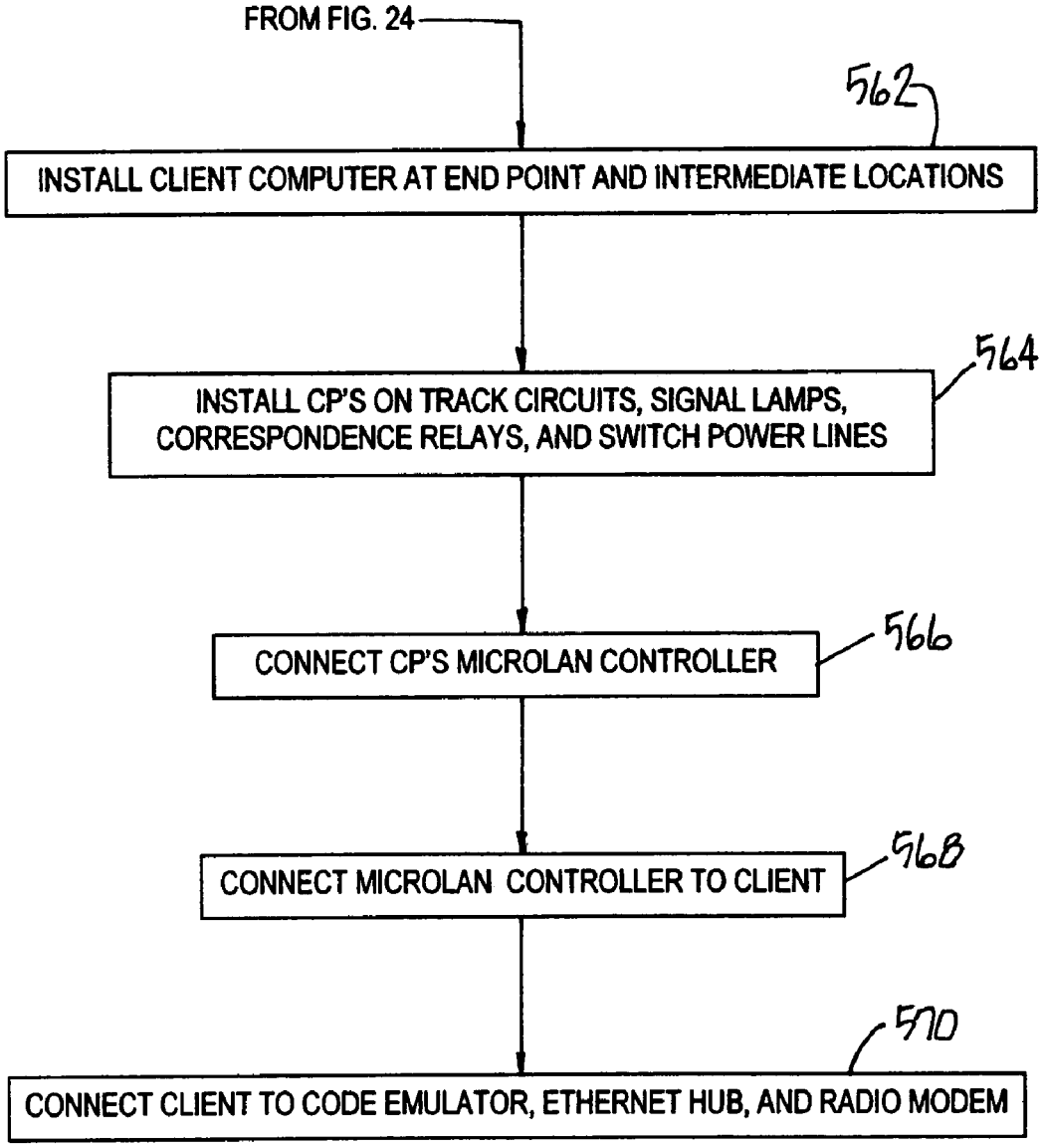

Referring to FIGS. 24 and 25, the steps related to the hardware installation is illustrated starting with block 550. First the server is installed at the interlocking to be tested, block 552. CPs are installed on the track circuits, signal lamps, relays and switch power lines, block 554. Next the CPs are connected to the Microlan controller, block 556 and the Microlan controller is connected to the server, block 558. The server is then connected to the code emulator, Ethernet hub and radio modem, block 560. Client computers are installed at the end point and intermediate locations, block 562. CPs are installed on the corresponding track circuits, signal lamps, relays and switch power lines, block 564. These CPs are connected to the Microlan controller, block 566, and to the client computer 568. Finally, the client computer is connected to the code emulator, Ethernet hub and radio modem, block 570, to complete the hardware setup as illustrated in FIG. 1.

It is to be understood that while certain forms of this invention have been illustrated and described, it is not limited thereto, except insofar as such limitations are included in the following claims and allowable equivalents thereof.

The invention claimed is:

1. A method for automatically testing a railroad signal system interlocking, said method comprising the steps of: (a) providing a control point interface corresponding to a predetermined function of an interlocking and having an isolated circuit section and a control section, (b) connecting the isolated circuit section of said interface to a current source in said interlocking having an electrical characteristic representing the status of said predetermined function, (c) coupling the control section of said interface to the isolated circuit section of the interface, (d) commanding said isolated circuit section of said interface to assume an electrical state indicative of the status of said predetermined function, (e) determining the electrical state of said isolated circuit section, and (f) reporting the status of said predetermined function in response to said state.

2. A method for automatically testing a railroad signal system interlocking having a plurality of components, said method comprising the steps of: (a) providing a plurality of control point interfaces, each corresponding to a predetermined function of an associated interlocking component and having an isolated circuit section and a control section, (b) connecting the isolated circuit section of each of said interfaces to a current source in the associated interlocking component having an electrical characteristic representing the status of the corresponding function executed by the interlocking component, and in each of said interfaces, (c) coupling the control section thereof to the isolated circuit section of the interface, (d) commanding the isolated circuit section to assume an electrical state indicative of the status of said corresponding function, (e) determining the electrical state of said isolated circuit section, and (f) reporting the status of said corresponding function in response to the determined state.

3. The method as set forth in claim 2 wherein said step (d) includes the steps of:

(d1) providing a model object corresponding to each of said interlocking components of said railroad signal system interlocking, (d2) configuring each of said model objects according to the operational characteristics of the corresponding interlocking component, (d3) defining an interface between predetermined model objects corresponding to adjacent interlocking components, (d4) defining signal routes through said model objects and interfaces to determine model information, (d5) deriving a signal aspect chart from said model information to define logical relationships of said interlocking components, (d6) generating test procedures from said model information and said logical relationships, and (d7) testing said railroad signal system interlocking according to said test procedures.

4. The method as set forth in claim 3 wherein said step (d7) includes automatically testing a switch of said interlocking.

5. The method as set forth in claim 4 wherein said step (d7) further comprises the steps of:

(d7a) visually verifying that said switch is in a normal position, (d7b) measuring system indications to validate that said switch is in said normal position, (d7c) commanding said switch to move to a reverse position, (d7d) visually verifying that said switch is in said reverse position, (d7e) measuring system indications to validate that said switch is in said reverse position, and (d7f) commanding the switch to move to said normal position.

6. The method as set forth in claim 5 further comprising the step of repeating steps d7a-d7f for each switch in said interlocking.

7. The method as set forth in claim 3 wherein said step (d7) includes automatically testing a track section of said interlocking.

8. The method as set forth in claim 7 wherein said step (d7) further comprises the steps of:

(d7a) shunting said track section with a predetermined track shunt, (d7b) determining the effect of said track shunt, (d7c) activating the associated control point interface to apply a CPI shunt to said track section, (d7d) determining the effect of said CPI shunt, and (d7e) deactivating said control point interface to remove said CPI shunt from said track section.

9. The method as set forth in claim 8 further comprising the step of repeating steps d7a-d7e for each track section in said interlocking.

10. The method as set forth in claim 3 wherein said step (d7) includes automatically testing a signal lamp of said interlocking.

11. The method as set forth in claim 10 further comprising the steps of:

(d7a) verifying that said signal lamp is illuminated, (d7b) measuring an electrical current to said signal lamp, (d7c) verifying that said current is above a predetermined threshold, (d7d) deactivating the associated control point interface to extinguish said signal lamp, (d7e) verifying that said signal lamp is extinguished, (d7f) measuring said current to said signal lamp, and (d7g) verifying that said current is below a predetermined threshold.

12. The method as set forth in claim 11 further comprising the step of repeating steps d7a-d7g for each signal lamp in said interlocking.

13. In a system for automatically testing a railroad signal system interlocking: a control point interface corresponding to a predetermined function of an interlocking and having an isolated circuit section and a control section, said isolated circuit section being connected with the interlocking and having a normal, inactivated state during operation of the interlocking, and an activated state for testing the interlocking by detecting an electrical characteristic representing the status of the predetermined function executed by the interlocking, said control section having a controller for driving said isolated circuit section to its activated state and receiving an output from said isolated circuit section in response to said detected electrical characteristic, and for delivering a status report to a central hub of the automatic testing system.

14. In the system as claimed in claim 13, wherein said isolated circuit section includes a switching component responsive to said controller and presenting said inactivated and activated states.

15. In the system as claimed in claim 14, wherein said isolated circuit section further includes a sensor responsive to a change of state of said switching component for providing said output from the isolated circuit section.

16. In the system as claimed in claim 15, wherein said sensor includes an inductor responsive to said change of state, and wherein said controller includes circuitry responsive to said output for reducing nonlinearity, and an analog digital converter responsive to said circuitry for providing said status report in a digital form.

* * * * *